US010120303B2

(12) United States Patent
Kojima et al.

(10) Patent No.: US 10,120,303 B2
(45) **Date of Patent: *Nov. 6, 2018**

(54) IMAGE FORMING SYSTEM

(71) Applicant: Ricoh Company, Ltd., Tokyo (JP)

(72) Inventors: Takeshi Kojima, Kanagawa (JP); Tomoya Ohmura, Kanagawa (JP); Sho Sekiguchi, Tokyo (JP); Taichi Urayama, Kanagawa (JP); Kazuya Saitoh, Kanagawa (JP); Takuya Moriyama, Kanagawa (JP); Hiroomi Tamura, Kanagawa (JP); Tetsuto Ueda, Kanagawa (JP); Naoyuki Ozaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/397,553

(22) Filed: Jan. 3, 2017

(65) Prior Publication Data

US 2017/0115609 A1 Apr. 27, 2017

Related U.S. Application Data

(63) Continuation of application No. 14/929,860, filed on Nov. 2, 2015, now Pat. No. 9,575,441.

(30) Foreign Application Priority Data

| | | |
|---|---|---|
| Nov. 7, 2014 | (JP) | 2014-227037 |
| Dec. 22, 2014 | (JP) | 2014-259034 |
| Sep. 18, 2015 | (JP) | 2015-184892 |

(51) Int. Cl.
*G03G 15/16* (2006.01)
*G03G 15/00* (2006.01)

(52) U.S. Cl.
CPC ..... *G03G 15/161* (2013.01); *G03G 15/1665* (2013.01); *G03G 15/6538* (2013.01); (Continued)

(58) Field of Classification Search
CPC ..... G03G 15/6538–15/655; G03G 15/161; G03G 15/1655; G03G 2215/00603; G03G 2215/00599
See application file for complete search history.

(56) References Cited

U.S. PATENT DOCUMENTS

| | | | |
|---|---|---|---|
| 5,729,788 | A | 3/1998 | Hirohashi |
| 6,173,135 | B1 | 1/2001 | Yuminamochi |

(Continued)

FOREIGN PATENT DOCUMENTS

| | | |
|---|---|---|
| JP | 2012-042641 | 3/2012 |
| JP | 2014-021379 | 2/2014 |
| JP | 2014-095882 | 5/2014 |

OTHER PUBLICATIONS

U.S. Appl. No. 14/742,596, filed Jun. 17, 2015.
U.S. Appl. No. 14/718,567, filed May 21, 2015.
U.S. Appl. No. 14/811,119, filed Jul. 28, 2015.

*Primary Examiner* — Carla Therrien
(74) *Attorney, Agent, or Firm* — Oblon, McClelland, Maier & Neustadt, L.L.P.

(57) ABSTRACT

An image forming system includes a post-processing unit capable of performing a post-processing on the sheet on which the toner image is formed. The image forming system is capable of executing a transfer cleaning operation to more toner from a transfer member to an image bearer by electrostatic force caused by cleaning bias applied by a bias applying unit in a state where the image bearer and the transfer member are rotated, to clean the transfer member, as an inter-sheet operation performed when at least one of inter-sheet areas that exist on the image bearer during a (Continued)

successive image forming period. The image forming system is capable of executing a rotation stop operation to stop rotation of the image bearer and the transfer member, as the inter-sheet operation when the post-processing is performed, in addition to the transfer cleaning operation, before or after the transfer cleaning operation is executed.

21 Claims, 21 Drawing Sheets

(52) U.S. Cl.
CPC ..... *G03G 2215/00599* (2013.01); *G03G 2215/00603* (2013.01)

(56) References Cited

U.S. PATENT DOCUMENTS

| | | | | |
|---|---|---|---|---|
| 6,650,850 | B2 | 11/2003 | Nishimura | |
| 2007/0279673 | A1 | 12/2007 | Utsunomiya | |
| 2012/0205853 | A1* | 8/2012 | Nakamura | B65H 29/20 270/58.01 |
| 2013/0156466 | A1 | 6/2013 | Bisaiji et al. | |
| 2013/0162706 | A1 | 6/2013 | Tombs | |
| 2013/0207334 | A1* | 8/2013 | Awano | B65H 31/38 270/58.17 |
| 2013/0259496 | A1 | 10/2013 | Kato | |
| 2014/0023388 | A1 | 1/2014 | Yoshida | |
| 2014/0126942 | A1 | 5/2014 | Kojima et al. | |
| 2014/0348521 | A1 | 11/2014 | Mase et al. | |

* cited by examiner

IMAGE FORMING SYSTEM

CROSS-REFERENCE TO RELATED APPLICATIONS

This application is a continuation of U.S. patent application Ser. No. 14/929,860, filed on Nov. 2, 2015, which claims priority to Japanese Patent Application No. 2014-227037 filed in Japan on Nov. 7, 2014, Japanese Patent Application No. 2014-259034 filed in Japan on Dec. 22, 2014, and Japanese Patent Application No. 2015-184892 filed in Japan on Sep. 18, 2015. The entire contents of each of the above applications are hereby incorporated by reference herein in entirety.

BACKGROUND OF THE INVENTION

1. Field of the Invention

The present invention relates to an image forming system.

2. Description of the Related Art

Conventionally, an image forming device that forms a transfer nip by bringing a transfer member into contact with the surface of an image bearer, applies transfer bias output from a transfer bias power supply to the transfer member, and transfers a toner image on the image bearer to a recording member conveyed to the transfer nip is known.

The image forming device described in Japanese Patent Application Laid-open No. 2012-42641 includes a photoconductor, which is a rotatable image bearer on which a toner image is formed, a transfer roller, which is a rotatable transfer member that comes into contact with the photoconductor and forms a transfer nip, and a power supply that applies bias to the transfer roller. The toner image on the photoconductor is transferred onto a sheet, by passing the sheet through the transfer nip, and applying transfer bias having a polarity reverse to the regular charge polarity of the toner to the transfer roller from the power supply. A transfer cleaning operation for cleaning the transfer roller is also executed as an inter-sheet operation, performed when at least one of inter-sheet areas that exist on the photoconductor passes through the transfer nip during a successive image forming period. In the transfer cleaning operation, while the photoconductor and the transfer roller are rotated, cleaning bias having the same polarity as the regular charge polarity of the toner is applied to the transfer roller from the power supply, and the transfer roller is cleaned by electrostatically moving the toner adhering on the transfer roller to the photoconductor.

An image forming system that ejects a sheet, on which an image is formed by the image forming device such as the above, from the image forming device to a post-processing device, and that can selectively execute a post-processing such as a binding processing and a folding processing on the sheet by the post-processing device is also known.

In the image forming system, to extend an interval between the sheets ejected from the image forming device to the post-processing device, so as to ensure post-processing time in the post-processing device, the length of the inter-sheet area is extended in the rotating direction of the photoconductor, compared with that when the post-processing is not performed in the post-processing device. Therefore, when the post-processing time is increased, an inter-sheet time, which is time that the inter-sheet area takes to pass the transfer nip, is increased. As a result, the inter-sheet time sometimes becomes longer than the time required to sufficiently clean the transfer roller by performing the transfer cleaning operation. When the post-processing that significantly increases the inter-sheet time as described above is performed as the inter-sheet operation, if the photoconductor and the transfer roller are kept rotating exceeding the time required to sufficiently clean the transfer roller by performing the transfer cleaning operation, the lives of the photoconductor and the transfer roller are shortened.

SUMMARY OF THE INVENTION

It is an object of the present invention to at least partially solve the problems in the conventional technology.

An image forming system includes: an image bearer that bears a toner image and rotatably provided; a transfer member that comes into contact with the image bearer, forms a transfer nip to transfer the toner image on the image bearer to a sheet, and is rotatably provided; a bias applying unit that applies bias to the transfer member; and a post-processing unit capable of performing a post-processing on the sheet on which the toner image is formed. The image forming system is capable of executing a transfer cleaning operation to move toner from the transfer member to the image bearer by electrostatic force caused by cleaning bias applied by the bias applying unit in a state where the image bearer and the transfer member are rotated, to clean the transfer member, as an inter-sheet operation performed when at least one of inter-sheet areas that exist on the image bearer during a successive image forming period during which a plurality of sheets are successively fed to form images, passes through the transfer nip. The image forming system is capable of executing a rotation stop operation to stop rotation of the image bearer and the transfer member, as the inter-sheet operation when the post-processing is performed, in addition to the transfer cleaning operation, before or after the transfer cleaning operation is executed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Figure 2:
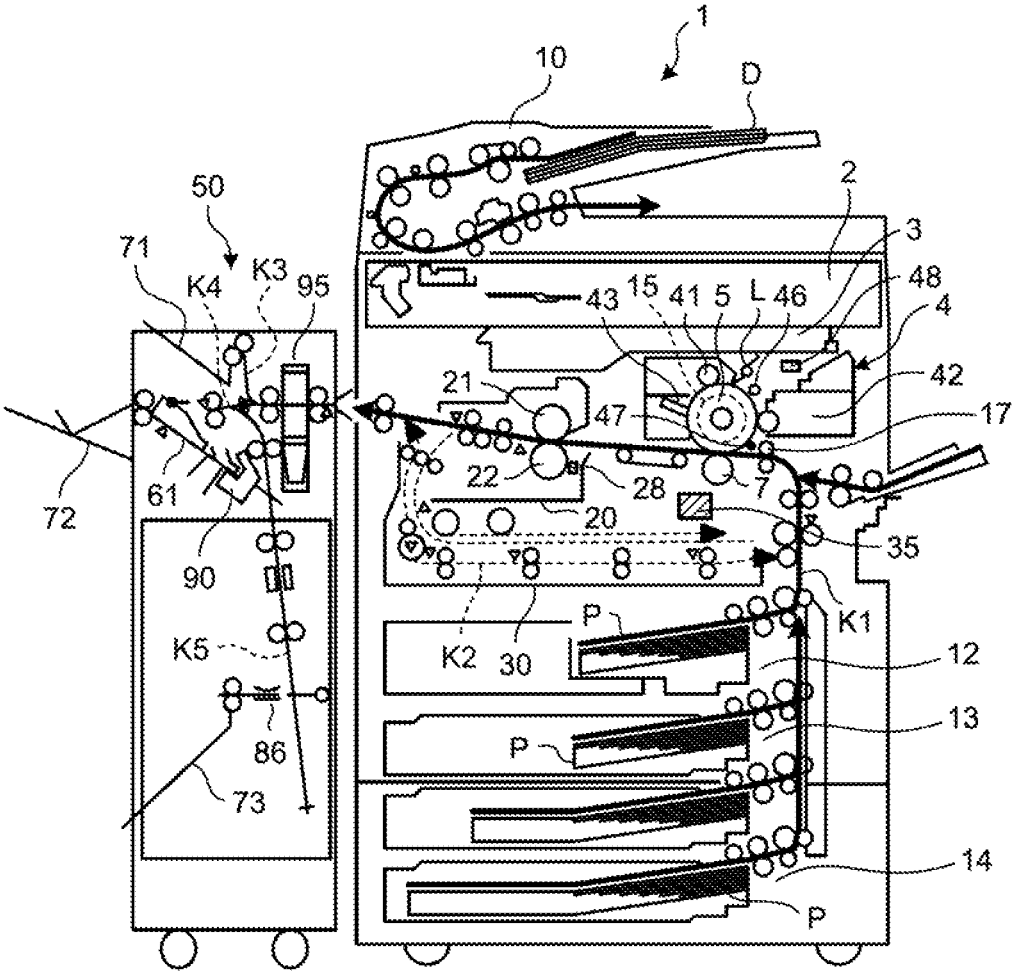
FIG. 2 is a schematic configuration diagram of an image forming system according to a first embodiment.

A first embodiment according to the present invention will now be described with reference to the accompanying drawings. FIG. 2 is a schematic configuration diagram of an image forming system according to the present embodiment. The image forming system according to the present embodiment includes a copier 1, which is an image forming device, and a post-processing device 50, which is a sheet processing device that performs a post-processing on a sheet P ejected and delivered from the copier 1. The post-processing device 50 is detachably attached to the copier 1.

As illustrated in FIG. 2, an image formation unit 4 includes a photoconductor drum 5, a charging roller 41, a developing device 42, a transfer roller 7, a cleaning device 43, and the like. More specifically, the photoconductor drum 5, which is an image bearer, is a negative charge-type organic photoconductor, provided with a photoconductive layer and the like on a drum-shaped conductive supporting body. The photoconductor drum 5 is produced by sequentially depositing an under coating layer, which is an insulating layer, a charge generating layer and a charge transport layer, which are photoconductive layers, on the conductive supporting body, which is a base layer. The photoconductor drum 5 is a driven member driven by a driving motor 15, which is a driving unit, during an image formation operation. The photoconductor drum 5 rotates in a clockwise direction in FIG. 2.

The charging roller 41 is a roller member made by covering the outer periphery of a conductive cored bar with a middle resistance elastic layer. The charging roller 41 is arranged so as to come into contact with the photoconductor drum 5. A predetermined charging bias is applied to the charging roller 41 from a charging power supply, thereby uniformly charging the surface of the photoconductor drum 5 facing thereto.

The developing device 42 mainly includes a developing roller facing the photoconductor drum 5, two conveying screws arranged side-by-side via a partition member, and a doctor blade facing the developing roller. The developing roller is configured of a magnet that is fixed inside the developing roller and forms a magnetic pole at the peripheral surface of the roller, and a sleeve that rotates around the magnet. The magnet forms a plurality of magnetic poles on the developing roller, and the developing roller bears a developer thereon. The developing device 42 accommodates a two-component developer composed of a carrier and toner. A toner container that accommodates new toner is detachably (exchangeably) installed in the developing device 42. With the developing device 42 configured in this manner, in a developing region where the developing roller is placed opposite to the photoconductor drum 5, the toner on the developing roller moves toward an electrostatic latent image formed on the photoconductor drum 5, by the electric field formed in the developing region. Thus, a desired toner image is formed on the photoconductor drum 5.

In the present embodiment, the developing device 42 is configured so as to be driven by the driving motor 15 that rotatably drives the photoconductor drum during the image formation operation. In other words, the photoconductor drum 5 is rotatably driven, when the driving force is transmitted from the driving motor 15 to the photoconductor drum 5. The driving force is also transmitted to the developing roller and the conveying screws of the developing device 42 from the driving motor 15 via a gear train. Thus, the rotating members are rotatably driven. In this manner, the developing device 42 functions as a driven member driver by the driving motor 15. In the present embodiment, the driving motor 15 can also drive other constituting members of the photoconductor drum 5 and the developing device 42, as driven members.

The toner used in the present embodiment is used for high-speed machines and is a low melting point toner. More specifically, the toner in the present embodiment contains binder resin, and the binder resin includes at least polyester resin (A) having crystallinity, non-crystalline resin (B), non-crystalline resin (C), and composite resin (D) including a polycondensation resin unit and an addition polymerization resin unit. The non-crystalline resin (B) contains a chloroform-insoluble component. The softening temperature (T½) of the non-crystalline resin (C) is lower than that of the non-crystalline resin by More than 25 degrees Celsius. The toner has a main peak between 1,000 and 10,000 in a molecular weight distribution obtained by gel permeation chromatography (GPC) of a tetrahydrofuran (THF) soluble matter, and the half value width of the molecular weight distribution is set to equal to or less than 15,000. Such toner has a low melting point and is suitable as toner for a high-speed image forming device as described above. However, it easily adheres to the transfer roller 7 when the charge amount is reduced due to adhesion of paper dust and the like. As a result, the specific effects (effects of efficiently cleaning the toner adhering to the transfer roller 7) of the image forming system according to the present embodiment, which will be described below, can be particularly effectively exhibited.

A cleaning blade is installed in the cleaning device 43. The cleaning blade comes into contact with the photoconductor drum 5, and removes untransferred toner, which is a substance adhering on the surface of the photoconductor drum 5. The cleaning blade is configured of a plate-shaped blade main body held by a holding plate. The blade main body is made of a rubber material such as urethane rubber, hydrin rubber, silicone rubber, and fluororubber. The cleaning blade comes into contact with the surface of the photoconductor drum at a predetermined angle under a predetermined pressure. Hence, the untransferred toner adhering on the photoconductor drum 5 is mechanically scraped off and collected in the cleaning device 43.

In the present embodiment, a recycle path may also be installed. The recycle path supplies the untransferred toner removed by and collected in the cleaning device 43 to the developing device 42 as recycle toner.

The transfer roller 7, which is a transfer rotating body, is a roller member made by covering the outer periphery of the conductive cored bar with an elastic layer having a resistance value (resistance value when the temperature is 23 degrees Celsius, the relative humidity (RH) is 50%, and the direct current voltage of 1,000 [V] is applied) of about $10^6$ [Ω] to $10^9$ [Ω]. A transfer nip is formed when the transfer roller 7 is pressed against the photoconductor drum 5. The transfer roller 7 is driven by the driving force input from the driving motor 15 via the gear train, and rotates in a counterclockwise direction in FIG. 2.

In the present embodiment, the driving motor 15 for the photoconductor drum 5 rotatably drives the transfer roller 7. However, the transfer roller 7 may also be rotatably driven by a separate driving motor. The transfer roller 7 may also be driven to rotate by the frictional force with the photoconductor drum 5, without inputting the driving force from the driving motor 15.

The copier 1 also includes a power supply unit 35, which is a bias applying unit that applies transfer bias to the transfer roller 7, and transfers a toner image borne on the photoconductor drum 5 onto the sheet P conveyed to the transfer nip. More specifically, transfer bias having a positive polarity, which is a reverse polarity to the regular charge polarity of the toner, is applied to the transfer roller 7 from the power supply unit 35. As a result, a toner image on the photoconductor drum 5 is transferred onto the sheet P conveyed to the transfer nip.

In the present embodiment, the power supply unit 35 is a power supply that applies transfer bias to the transfer roller 7 by constant current control. In the transfer device that performs the constant current control in this manner, the transfer bias applied to the transfer roller 7 is adjusted, by making the value of current that flows while a sheet is supplied, constant. By applying charge having a polarity reverse to the regular charge polarity of the toner to the back surface of the sheet P, it is possible to electrically dram the toner image on the photoconductor drum to the front surface of the sheet P.

In a transfer device using a direct transfer system, a transfer nip is formed between the photoconductor drum 5 and the transfer roller 7, and toner is directly transferred from the photoconductor drum 5 to the sheet P. In such a transfer device, the transfer roller 7 comes directly into contact with the photoconductor drum 5, when the sheet P is not placed in the transfer nip. As a result, when the transfer bias is applied to the transfer roller 7 in the state, background fog toner adhering on the surface of the photoconductor drum adheres on the transfer roller 7, thereby staining the transfer roller 7 with the toner. The background fog toner is toner that is not intended to adhere to the photoconductor drum 5 but adheres to a non-image portion, when the charging of the toner is insufficient or when mechanical pressure is applied. If the transfer roller 7 is stained with toner, the toner adheres to the back surface and the edge surface of the sheet P conveyed to the transfer nip.

In the present embodiment, transfer current is controlled so as not flow to the transfer roller 7, and cleaning bias is applied to the transfer roller 7, at an interval between the sheets and the like, as described below. Hence, toner is prevented from adhering to the transfer roller 7, and the toner adhering to the transfer roller 7 is cleaned by moving to the photoconductor drum 5.

With reference to FIG. 2, an operation performed in the copier 1 during a normal image formation (image formation operation) will now be described. A document D is conveyed from a document platen in the arrow direction in FIG. 2, by a conveyance roller of a document conveyance unit 10, and passes above a document reading unit 2. At this time, the image information on the document D that passes above the document reading unit 2 is optically read by the document reading unit 2. The optical image information read at the document reading unit 2 is converted to electrical signals, and transmitted to an exposure unit 3. Exposure light L such as a laser beam based on the image information of the electrical signals, is emitted from the exposure unit 3 toward the photoconductor drum 5 of the image formation unit 4 in the main-scanning direction (in the axis direction of the photoconductor drum), by a polygon mirror rotatably driven by the driving motor for the exposure unit 3.

In the image formation unit 4, the photoconductor drum 5 is rotating in the clockwise direction in FIG. 2, by receiving a driving force from the driving motor 15. A toner image corresponding to the image information is formed on the photoconductor drum 5, after going through a predetermined image formation process (a charging process, an exposure process, and a developing process). The toner image formed on the photoconductor drum 5 is then transferred onto the sheet P conveyed by a registration roller 17, at the transfer nip between the transfer roller 7 and the photoconductor drum 5.

The sheet P conveyed to the position (transfer nip) of the transfer roller 7 operates as follows. Among a plurality of paper feeding units 12, 13, and 14 provided at the lower part of the copier 1, one feeding unit is selected either automatically or manually. Here, it is assumed that the paper feeding unit 12, which is the uppermost unit, is selected. The uppermost sheet of the sheets P stored in the paper feeding unit 12 is conveyed toward the position of a conveyance path K1. The sheet P then passes through the conveyance path K1, in which a plurality of conveyance rollers are arranged, and reaches the position of the registration roller 17. The sheet P that has reached the position of the registration roller 17 is conveyed toward the transfer nip at the timing the sheet P is aligned with the toner image formed on the photoconductor drum 5. The sheet P, when the transfer process is finished, passes through the position of the transfer nip, and reaches a fixing device 20 through the conveyance path. The sheet P that has reached the fixing device 20 is interposed between a fixing belt 21 and a pressure roller 22, and the toner image is fixed thereon by the heat from the fixing belt 21, and the pressure from the fixing belt 21 and the pressure roller 22. The sheet P, on which the toner image is fixed, is sent out from a fixing nip located between the fixing belt 21 and the pressure roller 22, and discharged from the copier 1.

If a "both-sides printing mode" that prints both sides of the sheet P is selected, the sheet P on which the fixing process is performed on the front surface, is led to a both side conveyance path K2. The conveyance direction of the sheet P is reversed by a both side conveyance unit 30, and the sheet P is conveyed again toward the position of the transfer nip. An image is then formed on the back surface of the sheet P at the position of the transfer nip, by the image formation process (image formation operation) similar to that described previously. Then, after going through the fixing process at the fixing device 20, the sheet P passes through the conveyance path and is discharged from the copier 1.

In the image forming system according to the present embodiment, the post-processing device 50 is installed in the copier 1. The sheet P discharged from the copier 1 is conveyed to the post-processing device 50, and a post-processing is performed on the conveyed sheet P.

As illustrated in FIG. 2, the post-processing device 50 according to the present embodiment is configured to be capable of conveying the sheet P conveyed from the copier 1 to one of conveyance paths of a first conveyance path K3, a second conveyance path K4, and a third conveyance path K5, to perform different post-processings. The first conveyance path K3 is a conveyance path that elects the sheet P, which is conveyed from the copier 1, to a first paper ejection tray 71, as it is with performing no post-processing thereon. Alternatively, the first conveyance path K3 ejects the sheet P to the first paper ejection tray 71, by only performing punching processing by a punching device 95. The second conveyance path K4 is a conveyance path that piles the sheet P conveyed from the copier 1 to a piling unit 61. A binding device 90 then performs binding processing on the rear edge of the sheet. The second conveyance path K4 then elects the processed sheet P (a bundle of sheets) toward a second paper ejection tray 72 from a paper ejection opening 50*b* by a paper ejection roller 55. The third conveyance path K5 is a conveyance path that temporarily conveys the sheet P conveyed from the copier 1 to the second conveyance path K4. The third conveyance path K5 then switches back the sheet P, performs center-folding processing thereon by a center-folding plate 86, a sheet folding blade 84, and the like, and ejects the sheet P to a third paper ejection tray 73.

The first conveyance path K3, the second conveyance path K4, and the third conveyance path K5, which are the three conveyance paths described above, are switched by performing a switching operation of a bifurcating claw 81. When the sheet P is conveyed through the second conveyance path K4 and the third conveyance path K5, similar to when the sheet P is conveyed through the first conveyance path K3, the punching processing by the punching device 95 can also be performed.

Figure 3:
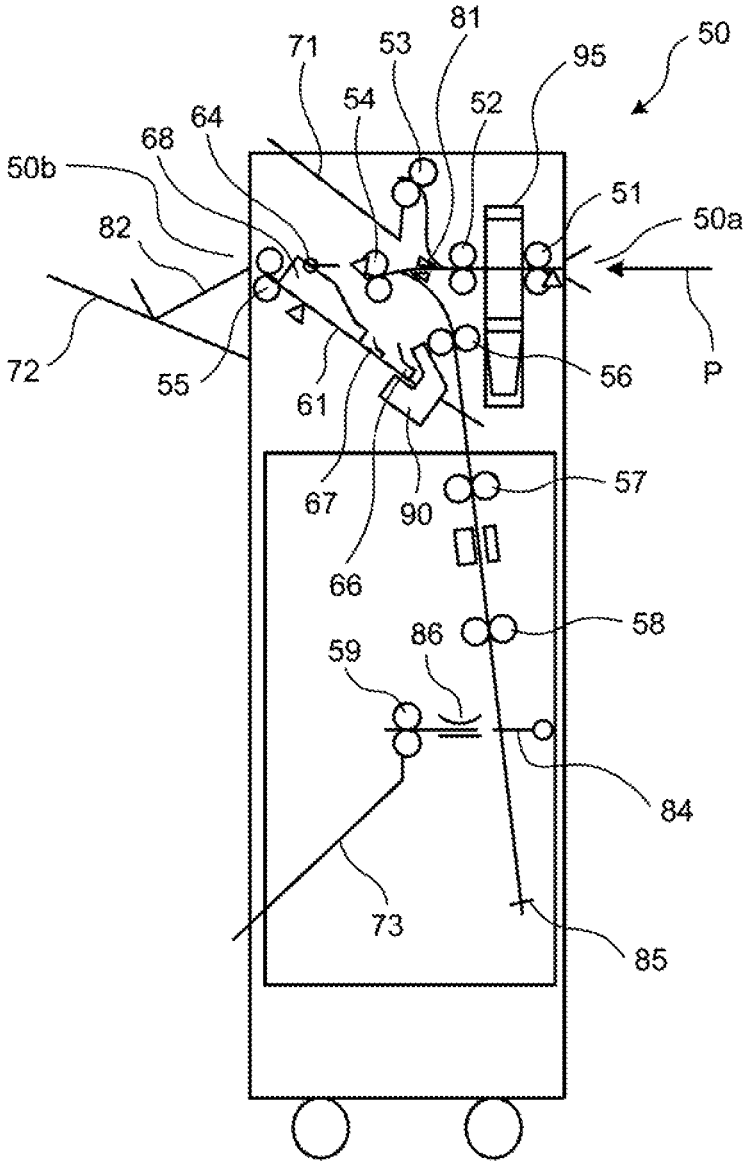
FIG. 3 is a schematic configuration diagram of a post-processing device.

More specifically, with reference to FIG. 3, a first conveyance roller 51 and a paper detection sensor are installed at the vicinity of an inlet port 50*a* of the post-processing device 50. The sheet P detected by the paper detection sensor is conveyed into the post-processing device 50 by the first conveyance roller 51 and a second conveyance roller 52. At this time, when a user selected punching processing in advance, the punching device 95 performs the punching processing on the sheet P. Based on a post-processing mode selected by the user in advance, the bifurcating claw 81 is rotated so that the sheet P is led to a desired conveyance path. If a mode of performing no post-processing is selected, the sheet P conveyed to the first conveyance path K3 is ejected by a third conveyance roller 53, and is discharged onto the first paper ejection tray 71.

If a "sort mode (sort processing mode)" is selected, the sheet P conveyed to the second conveyance path K4 is conveyed while shifting in the sheet width direction (in the direction vertical to the paper in FIG. 3), by a predetermined number of the sheet P, by a fourth conveyance roller 54 movably configured in the sheet width direction. The sheet P is then conveyed by the paper ejection roller 55, which is a fifth conveyance roller, and sequentially piled on the second paper ejection tray 72.

With reference to FIG. 3, a filler 82 is rotatably provided a round a supporting shaft at the upper end, at the upper side of the second paper ejection tray 72. The second paper ejection tray 72 is configured vertically movable by a moving mechanism. A sensor installed at the vicinity of the supporting shaft of the filler 82 detects the state in which the center portion of the sheet P in the conveyance direction sequentially piled on the second paper ejection tray 72 comes into contact with the filler 82. Thus, the height of the sheets P piled on the second paper ejection tray 72 is identified. The vertical position of the second paper ejection tray 72 is adjusted according to the increase and decrease of the number of sheets P piled on the second paper ejection tray 72. If the vertical position of the second paper ejection tray 72 reaches the lowest position, it is assumed that the number of sheets P piled on the second paper ejection tray 72 has reached the upper limit (full). Hence, a stop signal is transmitted from the post-processing device 50 to the copier 1 to stop the image formation operation.

While a series of post-processing operations is performed in the post-processing device 50 including the post-processings described above and the post-processings, which will be described below, the copier 1 is continuously operating. Therefore, even if the image formation process is not actually performed on the photoconductor drum 5, the image formation members such as the photoconductor drum 5 and the transfer roller 7 are rotatably driven.

If a "binding processing mode (stapling mode)" is selected, the sheet P conveyed to the second conveyance path K4 is conveyed without shifting by the fourth conveyance roller 54, and is sequentially piled on the piling unit 61. When a desired number of sheets P (a bundle of sheets) is piled on a placing surface 62 of the piling unit 61, a tapping roller 64 arranged thereabove moves to the position that comes into contact with the uppermost sheet P. When the tapping roller 64 is rotatably driven in the counterclockwise direction in FIG. 3, a multiple number of sheets P (a bundle of sheets) are conveyed toward a fence unit 66. Thus, the rear edge of the sheets P (a bundle of sheets) in the conveyance direction is abutted against the fence unit 66, thereby aligning the sheets P (a bundle of sheets) in the conveyance direction.

At this time, with reference to FIG. 3, jogger fences 68 provided at both ends of the piling unit 61 in the width direction move in the sheet width direction so as to nip the sheets P (a bundle of sheets) piled on the piling unit 61. Thus, the sheets P (a bundle of sheets) are also aligned in the width direction. The binding device 90 then performs binding processing on the rear edge of the sheets P (a bundle of sheets), which are aligned both in the conveyance direction and the sheet width direction. The sheets P (a bundle of sheets) on which the binding processing is performed, then move obliquely upward along the inclination of the placing surface 62 when a discharge claw 67 moves in the paper ejection direction. The sheets P (a bundle of sheets) are then conveyed by the paper ejection roller 55 and ejected on the second paper ejection tray 72.

If a "folding processing mode" is selected, the sheet P is first conveyed to the second conveyance path K4, and while the rear edge portion is nipped by the fourth conveyance roller 54, the sheet P is switched back by reversely rotating the fourth conveyance roller 54. The sheet P is then conveyed to the third conveyance path K5. The sheet P conveyed to the third conveyance path K5 is also conveyed by a sixth conveyance roller 56, a seventh conveyance roller 57, and an eighth conveyance roller 58, to a position where the center portion of the sheet P faces the sheet folding blade 84. At this time, the top end portion of the sheet P is abutted against a stopper unit 85. A desired number of sheets P (a bundle of sheets) are piled at the position. While the center portion of the sheets P (a bundle of sheets) is folded at the center by the sheet folding blade 84 that moves to the left side in FIG. 3, the sheets P are pressed, against the position of the center-folding plate 86, so that the center-folding processing is performed thereon. The sheets P (a bundle of sheets), on which the folding processing has been carried out, are then conveyed by a ninth conveyance roller 59 and ejected on the third paper ejection tray 73.

Figure 4:
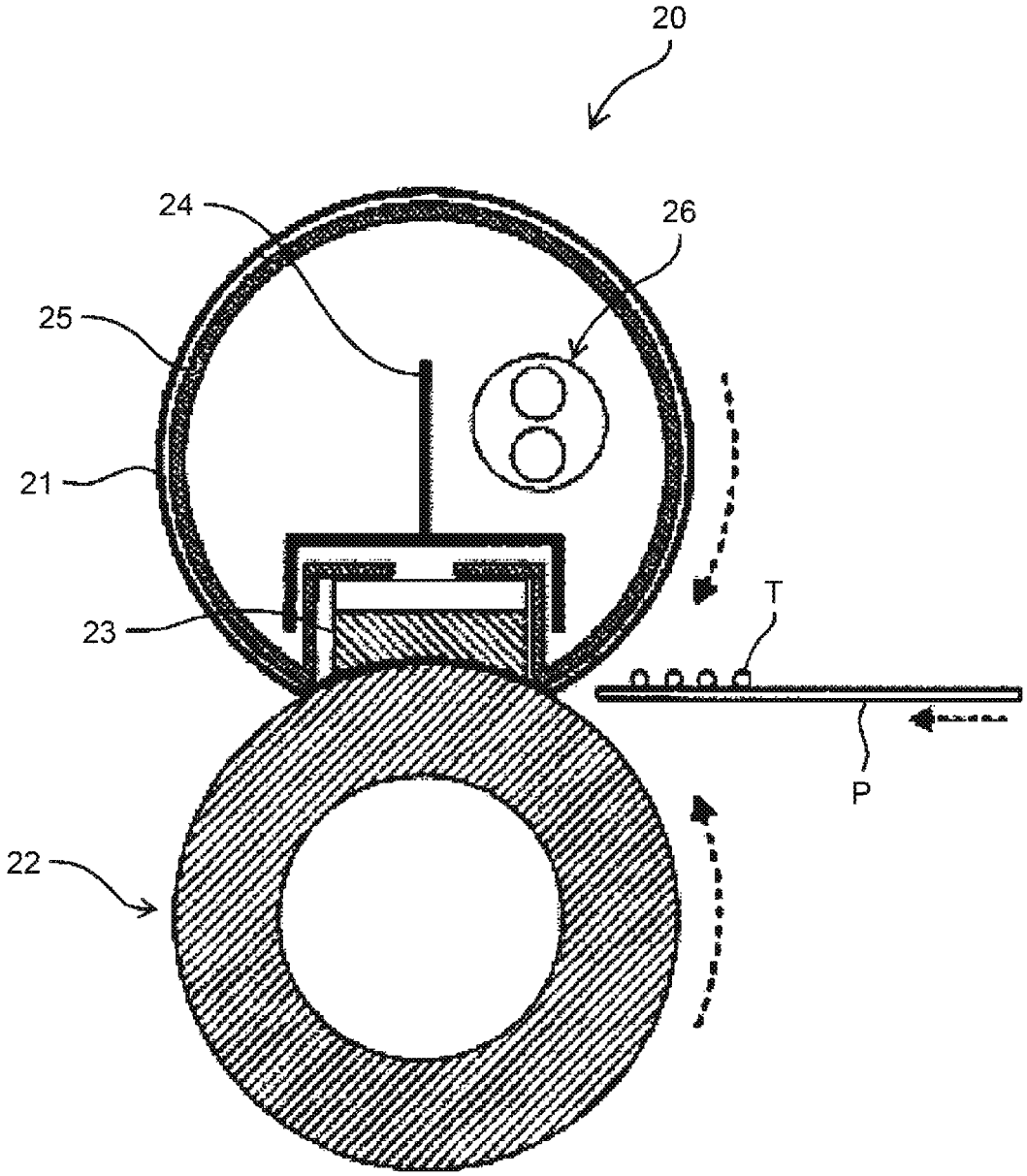
FIG. 4 is a schematic diagram of a configuration example of a fixing device installed in a copier.

FIG. 4 is a schematic diagram of a configuration example of the fixing device 20 installed in the copier 1. As illustrated in FIG. 4, the fixing, device 20 includes the fixing belt 21 which is an endless fixing member whose surface is movable, the pressure roller 22 which is a pressure rotating body that can be rotatably driven as a pressure member, a pressure receiving member 23 that receives pressure from the pressure roller 22 via the fixing belt 21, and the like. The pressure roller 22 is pressed against the fixing belt 21 and forms a desired fixing nip between both members. The pressure roller 22 is also rotatably driven in the arrow direction in the diagram. The side plate of the fixing device 20 rotatably supports both ends of the pressure roller 22 in the width direction via a bearing. If the pressure roller is a hollow cored bar, a heat source such as a halogen heater may be provided inside the cored bar.

A support stay 24, a heater 26, and the like are fixed inside the fixing belt 21. The fixing belt 21 forms a fixing nip between the pressure roller 22 and itself, by being pressed by the support stay 24 via the pressure receiving member 23. A heat conduction pipe 25 is provided so as to come into contact with the inner peripheral surface of the fixing belt 21, and conducts heat of the heater 26 to the fixing belt 21. The heater 26 is a heat source that generates heat to heat up the fixing nip. The heater 26 may be an infrared heater such as a halogen heater, a carbon heater, or the like.

For example, a temperature sensor such as a thermopile is arranged facing the surface of the fixing belt 21, and the output of the heater 26 is controlled based on the detection results of the surface temperature of the belt obtained by the temperature sensor. A temperature sensor such as a contact-type thermistor may also be arranged in the region inside the fixing belt 21 in which the light from the heater 26 is blocked by the support stay 24. The temperature sensor is arranged so as to come into contact with the inner peripheral surface of the fixing belt, and the output of the heater 26 may be controlled based on the detection results obtained by the temperature sensor. The temperature of the fixing belt 21 can be set to a desired target temperature, by controlling the output of the heater 26 such as the above.

A method to prevent a transfer roller from staining will now be described. On the surface of the photoconductor drum 5, in addition to the toner image formed by developing a latent image with toner, there is background fog toner. The background fog toner adheres on the background caused when the charge amount of the toner is not appropriate or when the toner mechanically comes into contact with the surface of the photoconductor drum 5. The amount of background fog toner is controlled to a level that cannot be visually observed on the sheet P, by controlling the toner density, the developing bias, the charging bias, and the like. However, it is very difficult to eliminate it completely.

As a result, there is always a certain amount of background fog toner on the surface of the photoconductor drum 5, and in a contact transfer system, such toner moves to the surface of a transfer member. In a transfer belt system, a blade is generally used to clean such toner from the surface of the transfer belt. There is also a system, such as a transfer roller system, that does not use the blade to mechanically clean the surface of the transfer roller, but moves the toner from the surface of the transfer roller to the photoconductor drum, using electrostatic force by applying bias. Particularly, because the configuration of the transfer roller system is simple and small in size, it has been widely used in monochrome machines. In such a transfer roller system, transfer cleaning is generally performed before or after an image is formed. In the transfer cleaning, cleaning bias is applied to return the toner to the photoconductor drum from the surface of the transfer roller. However, during successive printing, in which a plurality of sheets P are printed successively, the transfer cleaning is not carried out in the middle of the successive printing. Thus, the toner may be accumulated on the surface of the transfer roller. When the toner is accumulated on the surface of the transfer roller, the toner may move to the sheet P from the surface of the transfer roller, staining the back surface and the edge surface of the sheet P. Hence, there is a method of preventing toner from accumulating on the surface of the transfer roller, by carrying out the transfer cleaning according to the number of sheets that has passed in the middle of the image formation operation during the successive printing. This prevents the staining of the back surface and the edge surface of the sheet P.

However, there is a mode that further accumulates the toner on the surface of the transfer roller. When a post-processing device capable of performing a post-processing such as toner stapling and punching is used, an interval between the sheets or an interval between the copies need to be increased, to perform the stapling operation and the punching operation. At this time, the photoconductor drum and the transfer roller of the image formation unit stand by in an idling state, causing the background fog toner on the photoconductor drum to move continuously to the surface of the transfer roller. In a normal image formation operation, the sheet P passes the transfer nip, and the sheet P picks up the toner adhering on the surface of the transfer roller at a level that cannot be visually observed. Hence, the accumulation of toner on the surface of the transfer roller can be reduced by that amount. However, during the idling operation, toner is continuously input to the surface of the transfer roller from the photoconductor drum. This further increases the accumulation of toner on the surface of the transfer roller, as compared with that of the normal successive operation.

In the image forming system according to the present embodiment, it is possible to prevent the staining of the back surface and the edge surface of the sheet P, caused by the accumulation of toner on the surface of the transfer roller, when the interval between the sheets is considerably extended as in the above. Furthermore, when the interval between the sheets is considerably extended as in the above, there is no need to operate the members of the image formation unit such as the photoconductor drum and the transfer roller. Thus, such operation is a useless operation. Therefore, the image forming system according to the present embodiment can also prevent the lives of the units, the supplies, and the parts from being shortened, and reduce the power consumption.

The interval between the sheets indicates an interval between the sheet P and the sheet P that are successively conveyed during printing. The interval between the copies is an interval between copies for each of which a stapling operation and/or the like is performed. However, in the present embodiment, the explanation is made under the assumption that both are the interval between the sheets. Hence, the interval between the copies is included in the interval between the sheets.

A cleaning operation of a transfer roller performed at the interval between the sheets, which is a characteristic of the present embodiment, will now be described with reference to Example 1 to Example 6 illustrated in FIGS. 5 to 10. In FIGS. 5 to 10, to simply explain the examples of the present embodiment, the interval length between the sheets differs in each example. The interval between the sheets is increased from FIG. 5 to FIG. 8 in ascending order. In the present embodiment, the operation corresponding to the inter-sheet time, which is the interval length between the sheets, is determined by the copier 1, the post-processing device 50, and the processing operations performed thereby.

In other words, if the inter-sheet time applies to the following condition (1), the productivity is prioritized and no action is taken (as a conventional operation). If the inter-sheet time applies to the following condition (2), transfer cleaning is carried out. If the inter-sheet time applies to the following condition (3), the operation is stopped.

Condition (1): Inter-Sheet Time<Transfer Cleaning Time

A condition in which the inter-sheet time of the combination of the copier 1, the post-processing device 50, and the processing operation performed thereby is shorter than a desired transfer bias cleaning time.

Condition (2): Transfer Cleaning Time≤Inter-Sheet Time<Time to Shutdown or Startup Operation A condition in which the inter-sheet time of the combination of the copier 1, the post-processing device 50, and the processing operation performed thereby is equal to or longer than a desired transfer cleaning time, but shorter than the time required to shutdown or startup the image formation operation.

Condition (3): Time to Shutdown or Startup Operation≤Inter-Sheet Time

Figure 5:
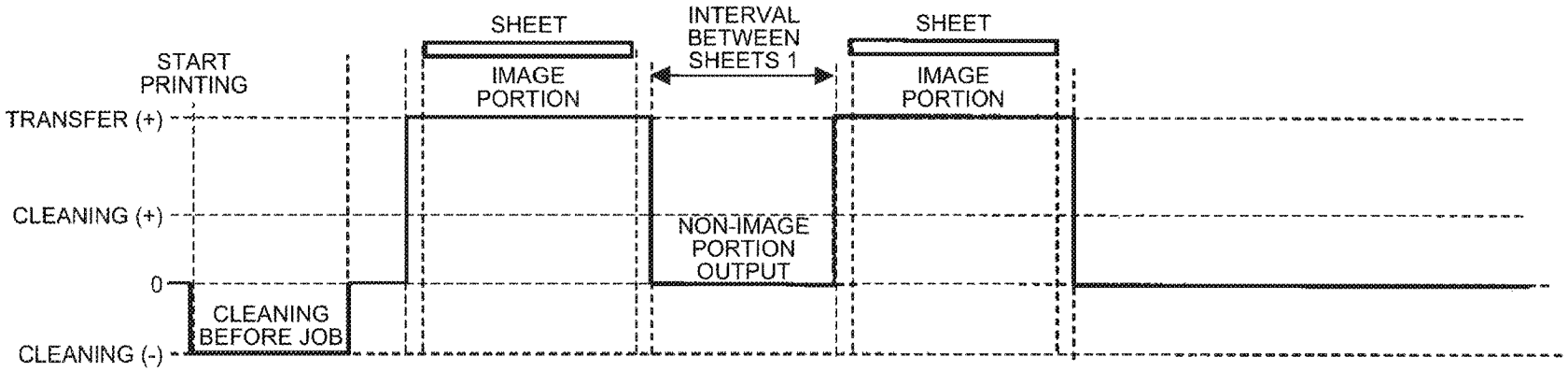
FIG. 5 is a timing chart according to Example 1.
Figure 6:
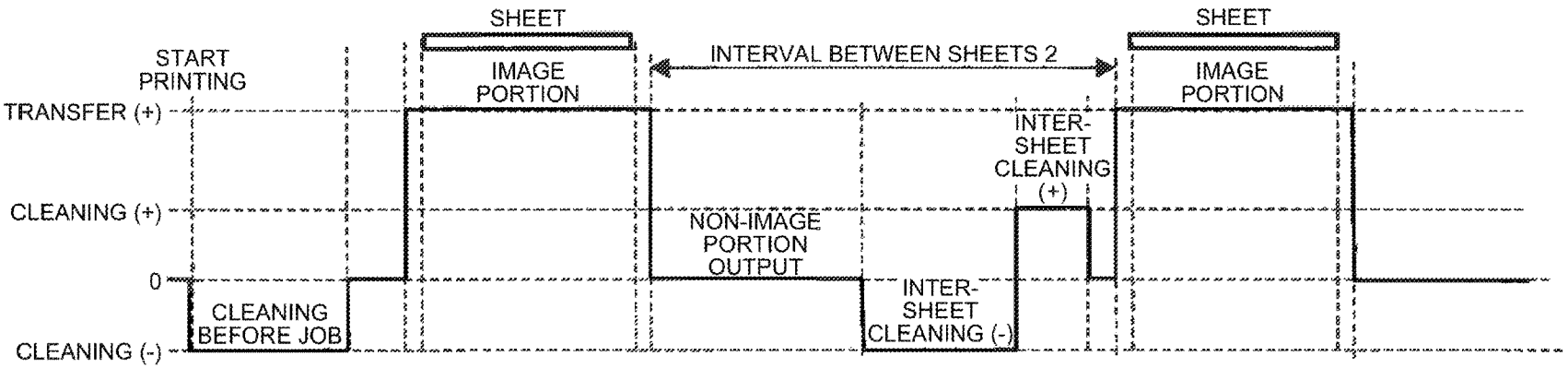
FIG. 6 is a timing chart according to Example 2.
Figure 7:
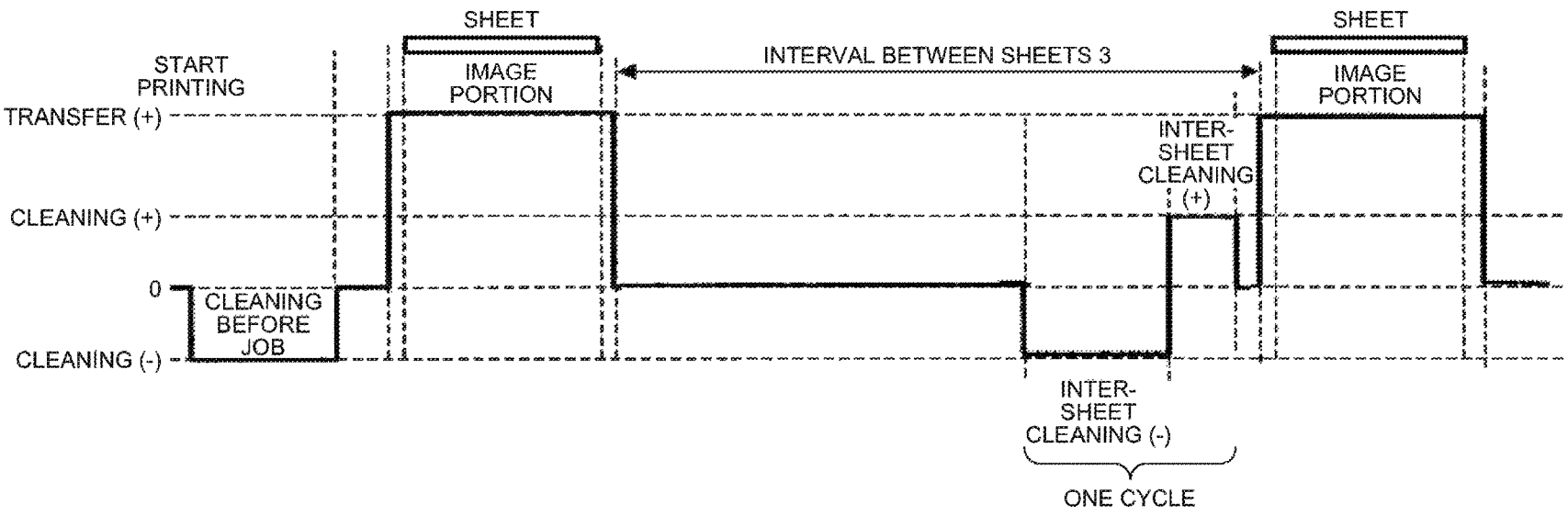
FIG. 7 is a timing chart according to Example 3.

A condition in which the inter-sheet time of the combination of the copier 1, the post-processing device 50, and the processing operation performed thereby is equal to or longer than the time required to shutdown or startup the image formation operation In the image formation operation of Example 1 performed in the timing chart illustrated in FIG. 5, the transfer roller is not cleaned at the interval between the sheets. In the image formation operations of Example 2 and Example 3 performed in the timing charts illustrated in FIG. 6 and FIG. 7, the transfer roller is cleaned at the interval between the sheets. Therefore, even if the interval between the sheets is extended, it is possible to prevent the staining of the back surface and the edge surface of the sheet P, by preventing the toner from accumulating on the surface of the transfer roller. There is also no possibility of reducing the productivity, because the interval between the sheets is not extended to include the cleaning of the transfer roller at the interval between the sheets to prevent staining.

Although the interval between the sheets is longer in Example 3 than that in Example 2, when the transfer roller is cleaned at Example 2 and Example 3, the time during which a minus voltage is applied and the time during which a plus voltage is applied are the same in both Example 2 and Example 3. In other words, the cleaning time of the transfer roller is constant regardless of the interval length between the sheets. If the transfer cleaning of the transfer roller is continuously performed during the long interval between the sheets, streaks may be generated on an image and the like, due to an electrical hazard on the photoconductor drum 5. When the sheet P is interposed between the transfer roller 7 and the photoconductor drum 5 while an image is being transferred, the sheet P prevents the hazard to the photoconductor drum 5. However, at the interval between the sheets, the transfer roller 7 and the photoconductor drum 5 come directly into contact with each other, increasing the hazard to the photoconductor drum 5. Therefore, a characteristic of the image forming system according to the present embodiment is, even if the interval length between the sheets is changed by various controls, to reduce hazard to the photoconductor drum 5, the cleaning time is controlled so as to be constant.

Figure 8:
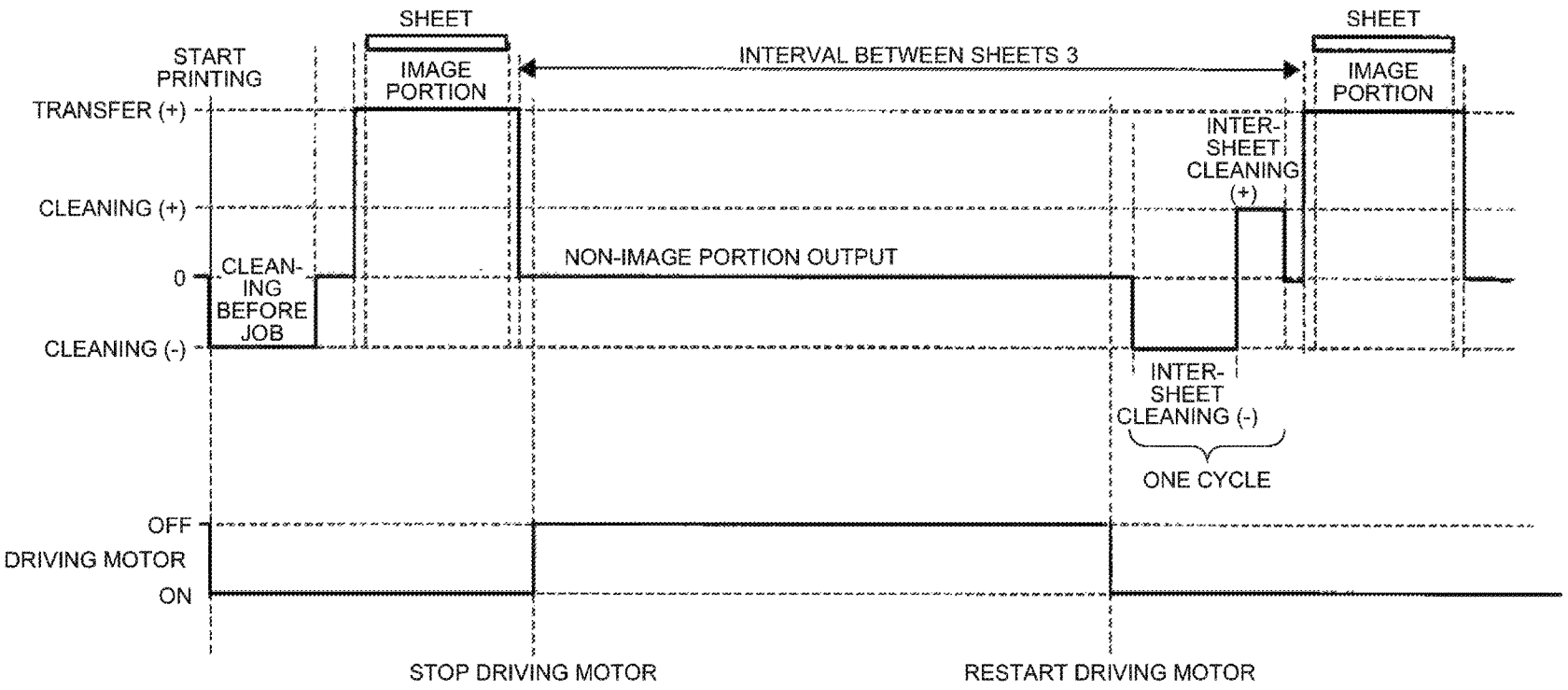
FIG. 8 is a timing chart according to Example 4.
Figure 9:
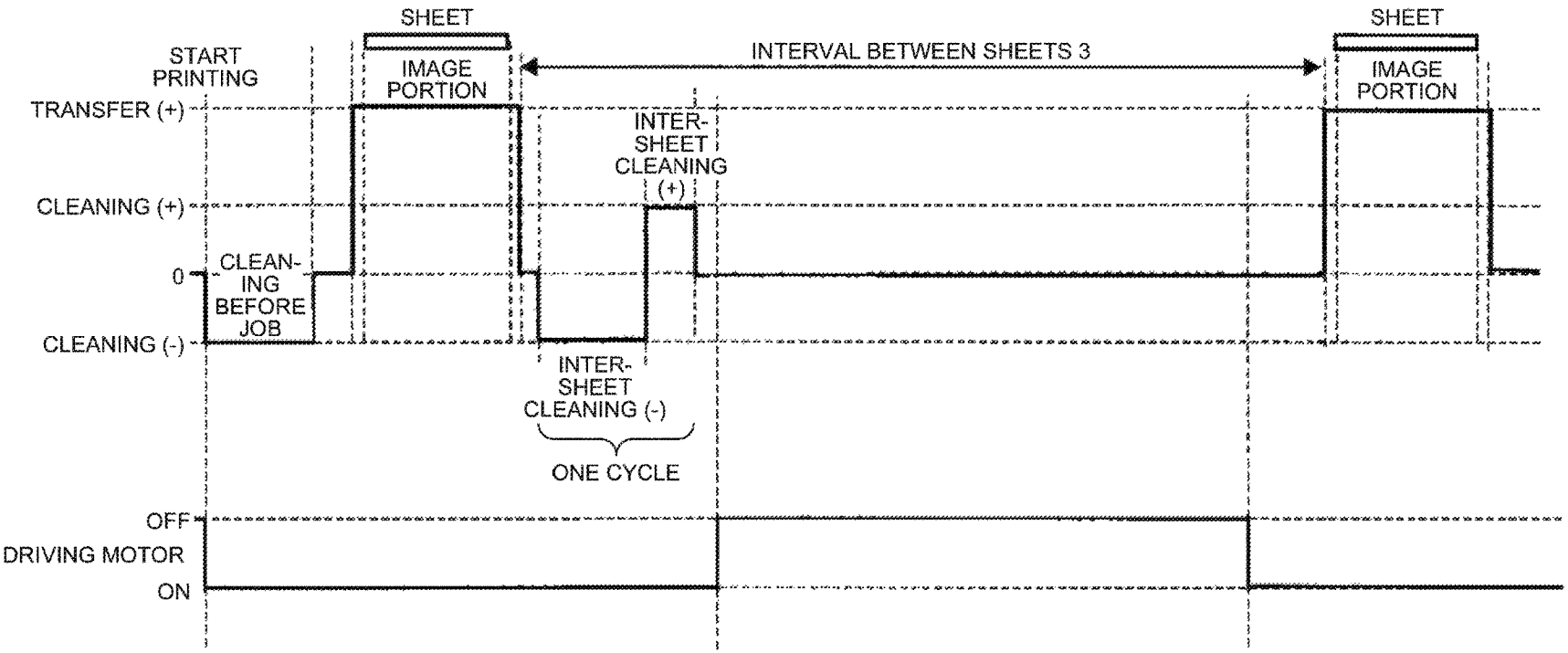
FIG. 9 is a timing chart according to Example 5.

As the image formation operations of Example 4 and Example 5 performed in the timing charts illustrated in FIG. 8 and FIG. 9, if a post-processing operation that significantly extends the inter-sheet time performed by the post-processing device 50 is included, the operation is stopped because the image formation operation can be stopped. A transfer cleaning may also be included before or after stopping the drive of the driving motor 15 that rotatably drives the photoconductor drum 5. As a result, it is possible to prevent the staining of the back surface and the edge surface of the sheet P, and also to prevent the lives of the units, the supplies, and the parts from being shortened.

Figure 10:
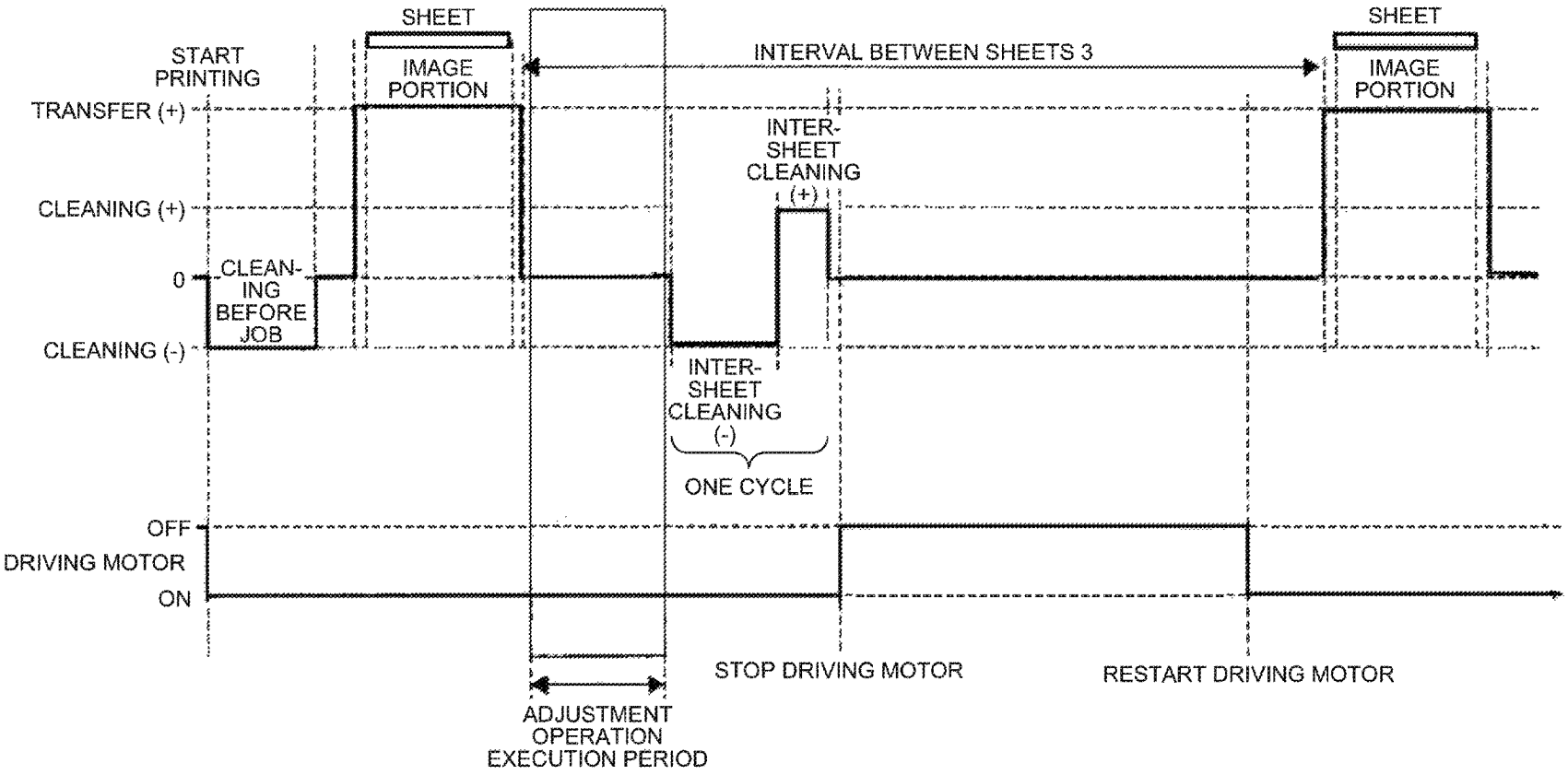
FIG. 10 is a timing chart according to Example 6.

As the image formation operation of Example 6 performed in the timing chart illustrated in FIG. 10, an adjustment operation may be carried out before stopping the operation. Examples of the adjustment operation include process control, toner refreshing, and image aligning. The benefit of doing so is that the adjustment operation, which is conventionally performed by lowering the productivity as described above, can be executed without lowering the productivity. In the image forming system according to the present embodiment, it is possible to carry out the adjustment operation such as the process control, the toner refreshing, and the image aligning by using a known method. Thus, the description thereof will be omitted.

Figure 11:
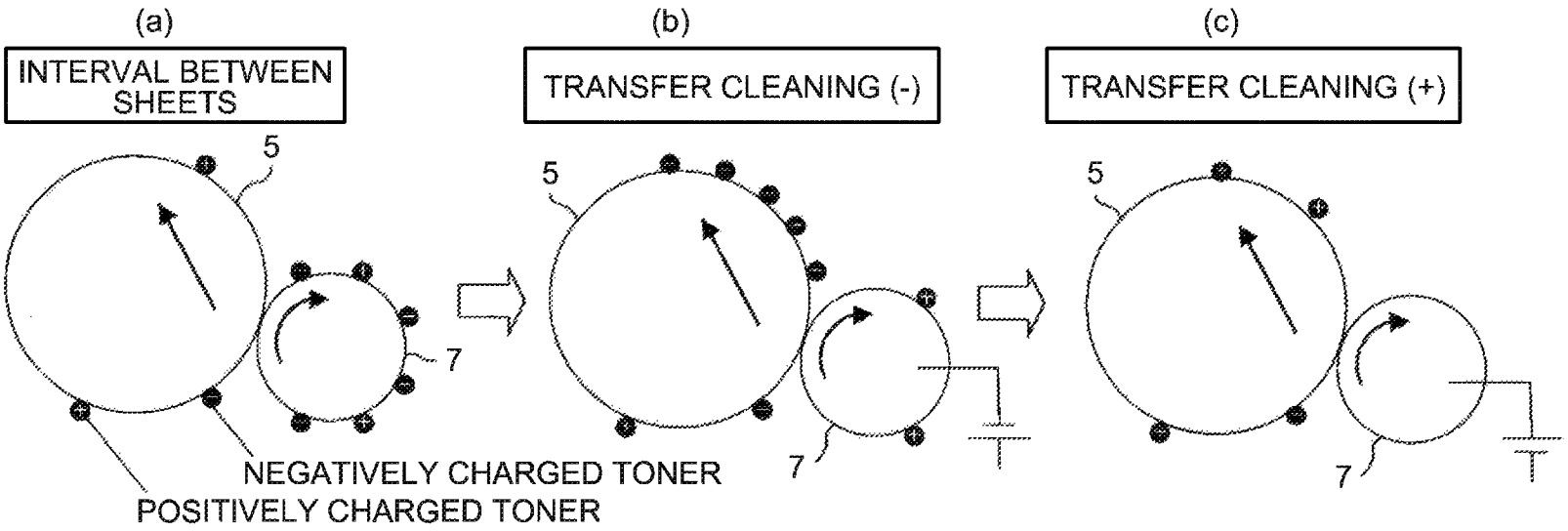
FIG. 11 is a diagram used to explain transfer cleaning performed on the surface of a transfer roller.

The cleaning on the surface of the transfer roller will now be described with reference to FIG. 11. At the interval between the sheets illustrated at (a) in FIG. 11, reversely charged toner and background fog toner of the reversely charged toner exist on the photoconductor drum 5. When such toner moves to the surface of the transfer roller, the toner is accumulated on the surface of the transfer roller. In this manner, FIG. 11 illustrates, at (a), a state in which the toner is accumulated on the transfer roller 7. The circles with "+" and "−" in the diagram indicate the polarity of the toner.

At (b) In FIG. 11 with the description of transfer cleaning (−), negative polarity bias is applied to the transfer roller 7. Consequently, it is possible to return the negatively charged toner adhering on the surface of the transfer roller 7 to the photoconductor drum 5. At (c) in FIG. 11 with the description of transfer cleaning (+), positive polarity bias is applied to the transfer roller 7. Consequently, it is possible to return the positively charged toner adhering on the surface of the transfer roller to the photoconductor drum 5. The background fog toner that stains the surface of the transfer roller has both positive polarity and negative polarity. Thus, by applying both of positive polarity bias and negative polarity bias, it is possible to further effectively prevent the staining of the back surface and the edge surface of the sheet P. In the image formation operation in Example 2 described above, the cleaning operation of the transfer roller 7 is included. In Example 2, cleaning is first performed by applying negative polarity bias to the transfer roller, followed by another cleaning performed by applying positive polarity bias to the transfer roller 7.

In the image formation operation in each example described above in the present embodiment, the transfer current (transfer output) is set to 0 [μA], excluding when the cleaning operation of the transfer roller 7 is performed at the interval between the sheets. This is because, if the transfer current is set to the plus side, the positively charged toner charged to the negative polarity is attracted to the surface of the transfer roller. If the transfer current is set to the minus side, the reversely charged toner having the positive polarity is attracted to the surface of the transfer roller. Therefore, if the interval between the sheets is extended, the toner is accumulated on the surface of the transfer roller. Hence, the back surface and the edge surface of the sheet P may be stained.

On the other hand, when the transfer current is set to 0 [μA], it is possible to prevent the toner from accumulating on the surface of the transfer roller at the interval between the sheets. It is also possible prevent the staining of the back surface and the edge surface of the sheet P, by refreshing the stain on the surface of the transfer roller by cleaning the transfer roller 7 afterwards. If the amount of toner accumulated on the surface of the transfer roller is large, there is a possibility that the toner on the surface of the transfer roller cannot be cleaned within the limited cleaning time of the transfer roller 7. However, by setting the transfer current to 0 [μA] at the interval between the sheets, the staining of the back surface of the sheet P that occurs when the toner on the surface of the transfer roller cannot be totally removed, will not occur.

It is also possible to clean the toner stain on the whole circumference of the transfer roller, by applying cleaning bias while the transfer roller 7 is rotated more than once. There is a possibility that the toner on the surface of the transfer roller cannot be totally removed while the transfer roller 7 is rotated only once, during which the cleaning bias is applied. Therefore, in the image formation operation in Example 1 described above, the negative polarity bias is applied to the transfer roller while the transfer roller 7 is rotated three times. The positive polarity bias is applied while the transfer roller 7 is rotated 0.9 times. The longer the cleaning bias is applied, the more effectively the cleaning can be performed. However, if the cleaning time is too long, it will be difficult to include the cleaning operation at the interval between the sheets. Consequently, the cleaning time needs to be set appropriately. Because the optimum cleaning time varies by the configuration of the copier 1, it needs to be optimized, accordingly.

In general, a condition to extend the interval between the sheets is when a post-processing such as stapling, punching, or center-folding is performed by using the post-processing device as described above. It is effective to control the inter-sheet cleaning of the present embodiment, while the post-processing device 50 described above is used.

Figure 12:
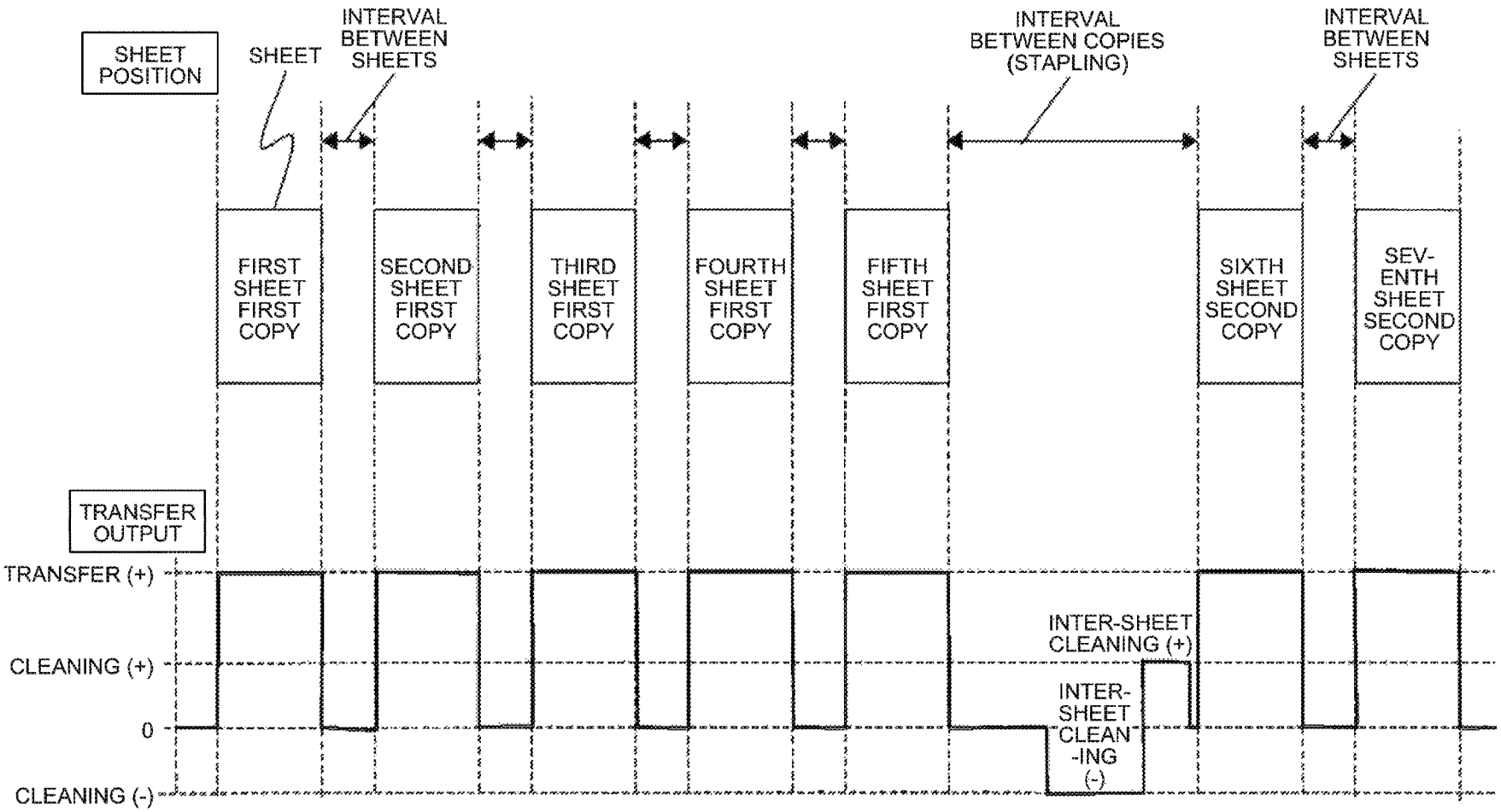
FIG. 12 is a timing chart of an image formation operation when the post-processing device carries out stapling processing.

FIG. 12 is an example of a timing chart of an image formation operation when the post-processing device 50 carries out stapling processing. The image formation operation of Example 7 performed in the timing chart illustrated in FIG. 12 indicates a sequence in which a stapling operation (binding operation) performed by the post-processing device 50 is inserted every time five sheets of paper is printed. The interval between the copies (interval between the sheets) between the fifth sheet and the sixth sheet is widened so that the stapling operation can be performed. In addition to the above, the post-processing operation performed by the post-processing device 50 includes control conditions such as punching and the like in which the interval between the sheets at every time is extended, and center-folding operation and the like in which the interval between the copies is significantly long. Thus, there is often a concern that the toner is accumulated on the surface of the transfer roller at the interval between the sheets. In the preset embodiment, it is possible to prevent the staining of the back surface and the edge surface of the sheet P, by refreshing the accumulation of toner stain on the surface of the transfer roller such as the above.

In recent years, a stapleless stapler has been attracting attention in view of resource saving and recyclability of the sheet P. The stapleless stapler joins the sheets by the meshing force between fibers in the sheet P. As a result, the binding force (force to bind the sheets) of a single stapling operation (binding operation) is weak, compared with that of stapling using normal staples. Thus, the binding force is obtained by performing two or more stapling, operations. This significantly increases the inter-copy (inter-sheet) time, and the effects of preventing the staining of the back surface and the edge surface of the sheet P, by controlling the cleaning on the surface of the transfer roller according to the present embodiment becomes more prominent.

When the interval between the sheets is extended, the toner stain is accumulated on the surface of the transfer roller. However, this not only happens in the direct transfer system, but it may also happen in an intermediate transfer system. The intermediate transfer system is widely used in color machines and in which an image is formed via an intermediate transfer belt. Consequently, the transfer cleaning control as described above is not limited to the direct transfer system. However, because toner is more easily accumulated on the transfer member in the direct transfer system, the effects of the transfer cleaning is exhibited more effectively in the direct transfer system.

The transfer cleaning is also effective in the transfer belt system, but a blade can also be used for regular cleaning. However, in the transfer roller system, to reduce the size of a machine and to reduce the cost, the transfer cleaning is generally used. Consequently, the effects of the transfer cleaning at the interval between the sheets as described above can further be obtained in a transfer roller-type image forming device.

Figure 13:
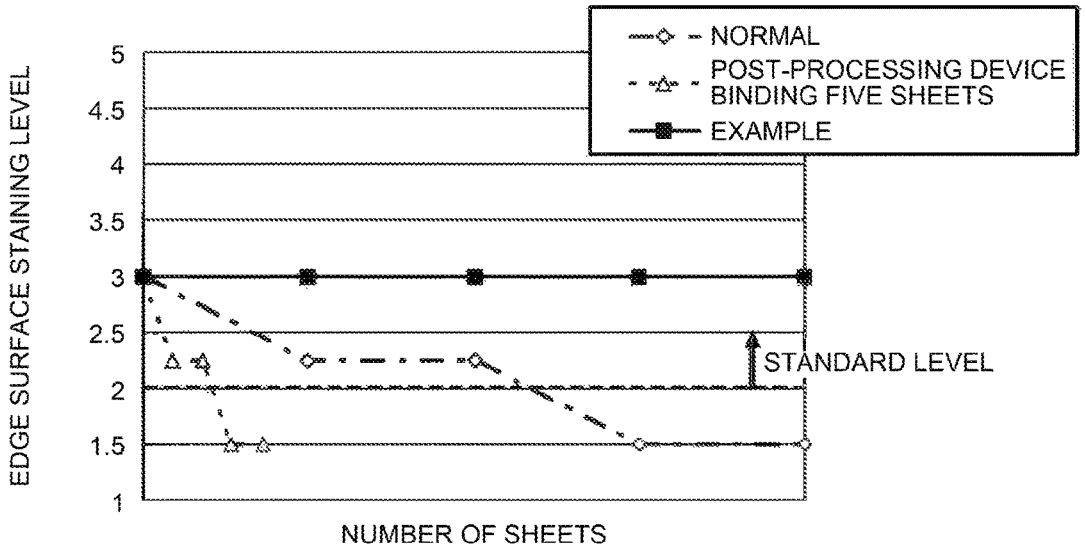
FIG. 13 is a graph illustrating evaluation results of the stain on the edge surface with respect to the number of sheets printed successively.

FIG. 13 is a graph illustrating evaluation results of the stain on the edge surface of the sheet P with respect to the number or sheets printed successively. The level of the stain on the edge surface is the level of the stain on the edge surface of the sheet P evaluated in a staged manner. The standard level is equal to or more than 2. At level 2, the sheet P is stained but normally, it cannot be easily recognized. There are five levels, and at level 5, the sheet P is not stained at all.

The conditions by which the sheet P is most prone to be stained in the image forming device used for the evaluation are selected as the evaluation conditions. In other words, the environment, is 27 degrees Celsius and humidity is 80%. The threshold of the background fog on the photoconductor drum is at the level where the background fog on the sheet P is small enough to be ignored, and the evaluation is performed at a state where the photoconductor drum has the background fog at the level. Because the transfer roller is more easily stained and tends to easily stain the sheet P over time, a transfer roller that has reached replacement life, and the image forming device having the printing speed of 30 copies per minute (cpm) are used for the evaluation.

The graph described as "normal" in FIG. 13 satisfies the condition that the transfer roller is not cleaned at the interval between the sheets, and the transition of staining at the normal interval between the sheets is evaluated. The graph described as "post-processing device binding five sheets" in FIG. 13 satisfies the condition that the interval between the sheets becomes considerably long due to stapling time (about 10 seconds). The graph described as "Example" in FIG. 13 is the example of the present embodiment described above. This example satisfies the condition that the transfer cleaning is performed by applying negative polarity bias to the transfer roller 7 at the interval between the sheets, while the transfer roller 7 is rotated three times, and positive polarity bias is applied to the transfer roller 7 at the interval between the sheets, while the transfer roller 7 is rotated 0.9 times.

FIG. 13 illustrates the tendency that the staining on the edge surface is worsened with respect to the number of printed sheets, if the transfer cleaning is not included, even if the condition satisfies the normal interval between the sheets. Furthermore, when the condition includes stapling operation performed by the post-processing device 50, the interval between the sheets is extended, and the staining on the edge surface is significantly worsened. When the stapling operation is performed, the edge surface is stained such that the number of printed sheets at which the staining goes below the standard level is about one sixth to that of the normal interval between the sheets. On the other hand, under the condition of the example of the present embodiment, the worsening of the stain on the edge surface is prevented, by cleaning the surface of the transfer roller at the interval between the sheets. As a result, the staining on the edge surface is not significantly worsened according to the number of printed sheets.

Figure 1:
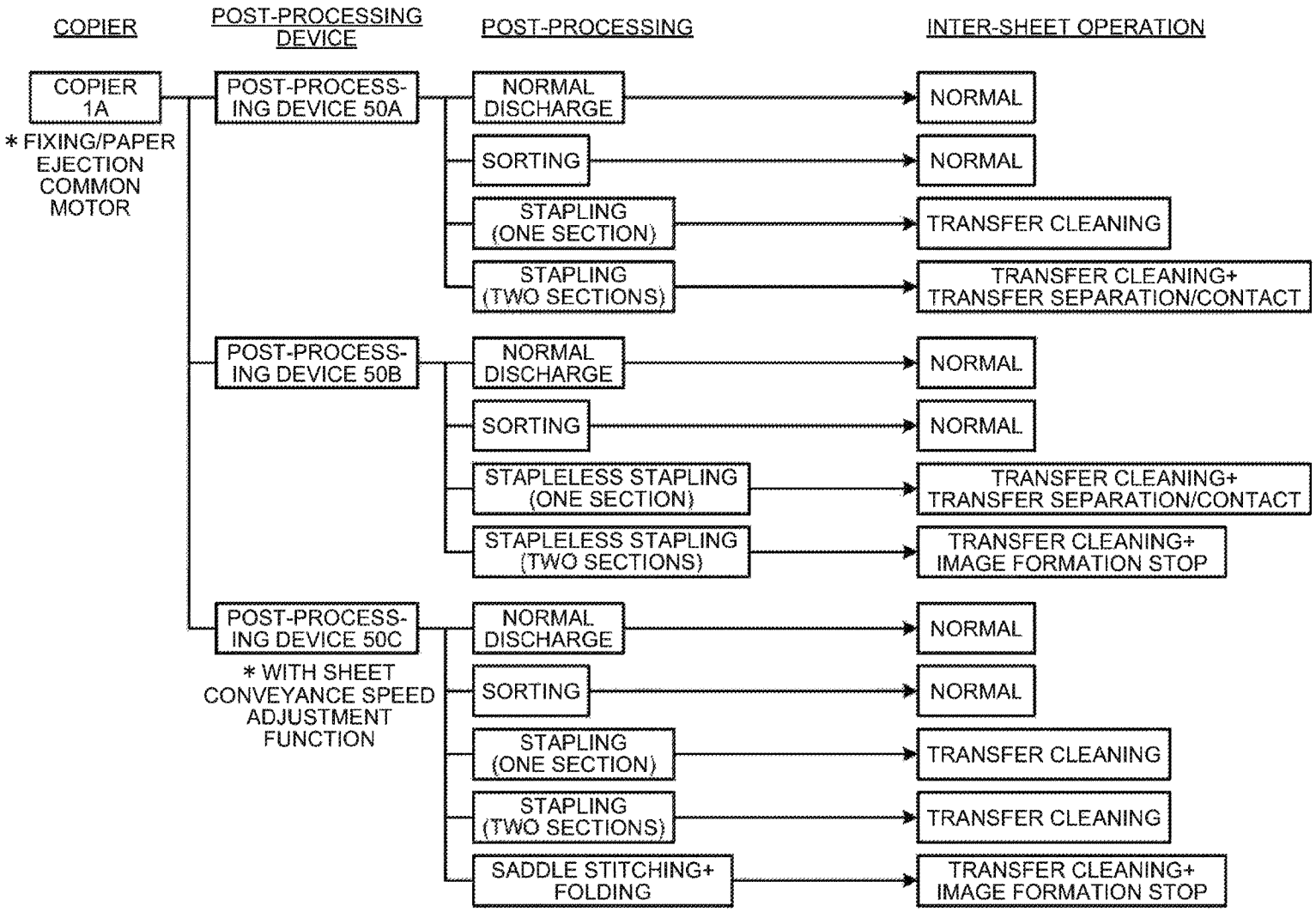
FIG. 1 is a diagram illustrating an example of a matrix of combinations of a copier and a post-processing device, and inter-sheet operations in post-processings performed by the post-processing device.
Figure 14:
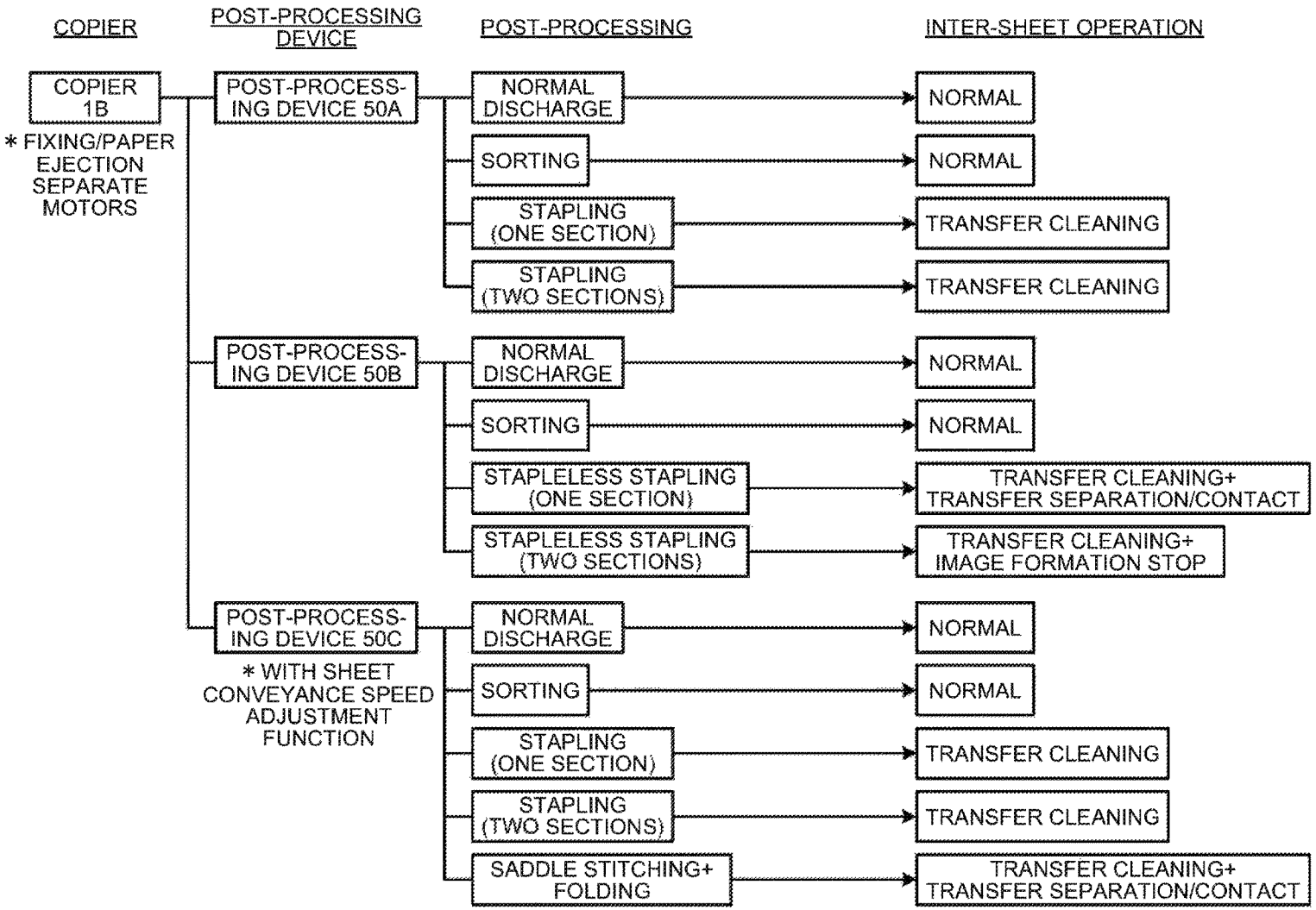
FIG. 14 is a diagram illustrating another example of a matrix of combinations of a copier and a post-processing device, and inter-sheet operations in post-processings performed by the post-processing device.

FIG. 1 and FIG. 14 illustrate a matrix of combinations of the copier 1 and the post-processing device 50 according to the present embodiment, and specific inter-sheet operations in post-processings performed by the post-processing device 50.

A copier 1A illustrated in FIG. 1 is a type of machine that uses a common motor to drive a fixing device and a paper ejection unit. While a sheet is delivered to post-processing devices 50A, 50B, and 50C, which are three different types of machines, from the copier 1A, the conveyance speed of the sheet P cannot be increased, and the sheet P is conveyed at a normal speed. Here, the sheet P is delivered from the copier 1A to the post-processing device 50A. As the post-processing performed in the post-processing device 50A becomes more complicated, the inter-sheet operation performed in the copier 1A at the interval between the sheets changes from normal, transfer cleaning, and transfer cleaning in addition to transfer separation/contact.

The photoconductor drum 5 and the transfer roller 7 separate and come into contact with each other in the copier 1A. While the photoconductor drum 5 is separated from the transfer roller 7, it is possible to include an adjustment operation to operate when the conditions such as the number of printed sheets and the operation travel distance become constant. The adjustment operation includes process control, displacement alignment, toner refreshing, and the like. In a stapling operation performed when the copier 1A is connected to the post-processing device 50B that includes a stapleless stapler for binding the sheets without using a staple, the binding operations is performed at a plurality of times, to staple one section of the sheet.

As a result, a certain time is required to carry out the stapling operation in the post-processing device 50B. Thus, the inter-sheet operation is different from that of the post-processing device 50A that performs normal stapling with staples. In other words, to perform a stapling operation to bind one section of the sheet P, in the copier 1A connected to the post-processing device 50A, transfer cleaning is performed as the inter-sheet operation. However, in the copier 1A connected to the post-processing device 50B, transfer cleaning in addition to transfer separation/contact is performed as the inter-sheet operation. To perform a stapling operation to bind two sections of the sheet P, in the copier 1A connected to the post-processing device 50A, transfer cleaning in addition to transfer separation/contact is performed as the inter-sheet operation. However, in the copier 1A connected to the post-processing device 50B, transfer cleaning in addition to an operation to stop image formation is performed as the inter-sheet operation.

In the post-processing device 50C that has a speed increasing function to increase the conveyance speed of the sheet P in the device, the inter-copy (inter-sheet) time can be adjusted by shortening it. Consequently, the inter-sheet operation of the copier 1A at the interval between the sheets becomes different in the post-processing operation, which is similar to that performed by the post-processing device 50A. In other words, to perform a stapling operation to bind two sections of the sheet P, in the copier A1 connected to the post-processing device 50A, transfer cleaning in addition to transfer separation/contact is performed as the inter-sheet operation. However, in the copier 1A connected to the post-processing device 50C, transfer cleaning is performed as the inter-sheet operation.

In a copier 1B, which is a type of machine that uses separate motors to drive the fixing device and the paper ejection unit illustrated in FIG. 14, it is possible to increase the conveyance speed of the sheet P, while the sheet is delivered to the post-processing devices 50A, 50B, and 50C, which are different types of machines, from the copier 1B. As a result, the processing ability of the copier 1B is enhanced than that of the copier 1A, because the conveyance speed to deliver the sheet P to the post-processing devices 50A, 50B, and 50C from the copier 1B is increased.

Particularly, while the copier 1B is connected to the post-processing device 50C, when the sheet P is delivered to the post-processing device 50 from the copier 1B, the conveyance speed of the sheet P can be increased in both the copier 1B and the post-processing device 50C. As a result, the inter-sheet time is shortened than that when the copier 1B is connected to the post-processing device 50B or the post-processing device 50C, and the inter-sheet operation is set to the one with short processing time. For example, when the stapling operation to bind one section of the sheet P is performed, in the copier 1B connected to the post-processing device 50B, transfer cleaning in addition to transfer separation/contact is performed as the inter-sheet operation. However, in the copier 1B connected to the post-processing device 50C, transfer cleaning is performed as the inter-sheet operation. When saddle stitching as well as folding is performed as a post-processing, in the copier 1A connected to the post-processing device 50C, transfer cleaning in addition to an operation to stop image formation is performed as the inter-sheet operation. In the copier 1B connected to the post-processing device 50C, transfer cleaning in addition to transfer separation/contact is performed as the inter-sheet operation.

As described above, the inter-sheet operations can be indicated in an understandable matrix, by the combinations of the copier 1 and the pest-processing device 50, and the post-processing operations thereof. By allowing the copier 1 to have control based on the table of the combinations, an optimum inter-sheet operation can be performed. As a result, it is possible to prevent the staining of the back surface and the edge surface of the sheet P, due to the toner stain on the surface of the transfer roller. It is also possible to prevent the lives of the units, the supplies, and the parts from being shortened, and to reduce the power consumption.

In the present embodiment, the image forming system is the copier 1 and the post-processing device 50 separately provided and arranged side by side. However, it is not limited thereto, and the image forming system may be the copier 1 integrally provided with the post-processing device 50.

Second Embodiment

A second embodiment according to the present invention will now be described with reference to the accompanying drawings. The schematic configuration of the image forming system according to the present embodiment is the same as the schematic configuration of the image forming system according to the first embodiment illustrated in FIG. 2. The schematic configuration of the post-processing device included in the image forming system according to the present embodiment is the same as the schematic configuration of the post-processing device illustrated in FIG. 3. An example of a fixing device installed in a copier included in the image forming system according to the present embodiment is the same as the example of the schematic configuration of the fixing device illustrated in FIG. 4.

Examples of a cleaning operation of a transfer roller performed at the interval between the sheets, in the image forming system according to the present embodiment are the same as Example 1 to 6 described by using the timing charts illustrated in FIG. 5 to FIG. 10. An example of an image formation operation when a stapling operation is carried out in the post-processing device included in the image forming system according to the present embodiment is the same as the example of the image formation operation described by using the timing chart illustrated in FIG. 12. An example of a matrix of combinations of the copier 1 and the post-processing device 50 according to the present embodiment, and specific inter-sheet operations in the post-processings performed by the post-processing device 50 is the same as the examples described with reference to FIG. 1 or FIG. 14.

The present embodiment is different from the first embodiment at a point that it includes a determining unit. The determining unit determines a selectable post-processing and an inter-sheet operation corresponding to the selectable post-processing, based on identification information of the post-processing device 50 installed in the copier 1 and an option member mounted on the post-processing device 50. Here, an optional part includes a staple unit for stapling processing no a punch unit for punching processing, for example, and are detachable with respect to the post-processing device 50.

As described in the matrix of the inter-sheet operation illustrated in FIG. 1 or FIG. 14 of the first embodiment, the inter-sheet operation performed at the interval of the sheets is changed, according to the combination of the copier 1 and the post-processing device 50, and the post-processing performed by the post-processing device 50. The inter-sheet operation needs to be changed depending on the inter-sheet time. The inter-sheet time is changed depending on the post-processing performed in the image forming system. The inter-sheet time is also changed if the processing ability of the post-processing device 50 installed to the copier 1, or an optional part 100 mounted on the post-processing device 50 is different, even if the post-processing performed in the image forming system is the same.

For example, when the image forming system is used as a printer, and the printer driver gives instructions to print a plurality of copies while performing a binding operation with a stapler, the inter-sheet time differs by the machine type of the copier 1, the machine type of the post-processing device 50 connected to the copier 1, and the post-processing device 50. The copier 1, which is a main body, generally controls the inter-sheet operation in the image forming system. The machine type of the copier 1 can be identified by software and a controller used in the copier 1. If identification information related to the machine type of the post-processing device 50 connected to the copier 1 and the model of the optional part installed in the post-processing device 50 can be obtained in the image forming system, it is possible to calculate the inter-sheet time and determine the inter-sheet operation, corresponding to each post-processing that can be executed in the image forming system.

The determining unit which is a feature unit according to the present embodiment that determines the inter-sheet operation corresponding to each post-processing that can be selected in the image forming system, will now be described below.

Example 1

Figure 15A:
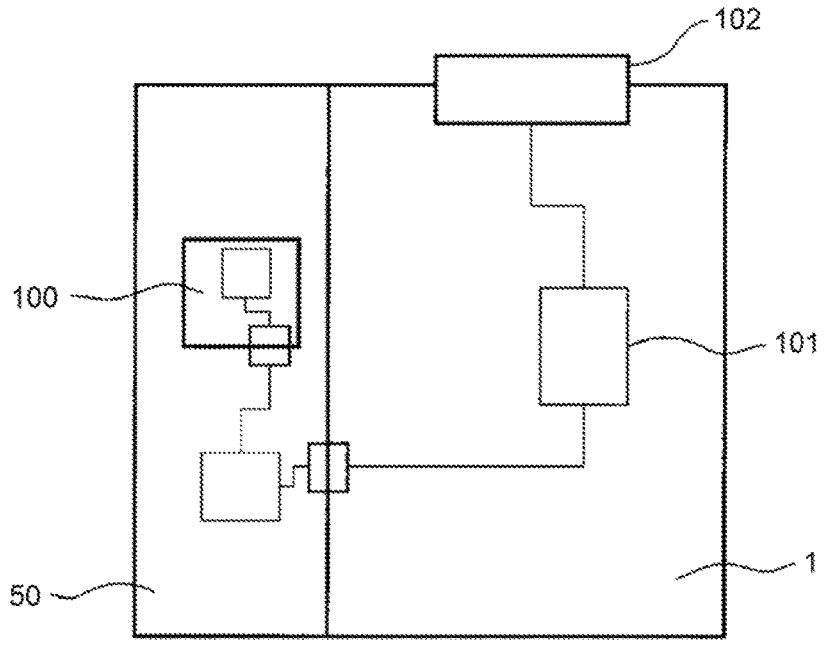
FIGS. 15A and 15B are schematic configuration diagrams of examples of a determining unit that determines an inter-sheet operation corresponding to each post-processing that can be selected in the image forming system according to a second embodiment.
Figure 15B:
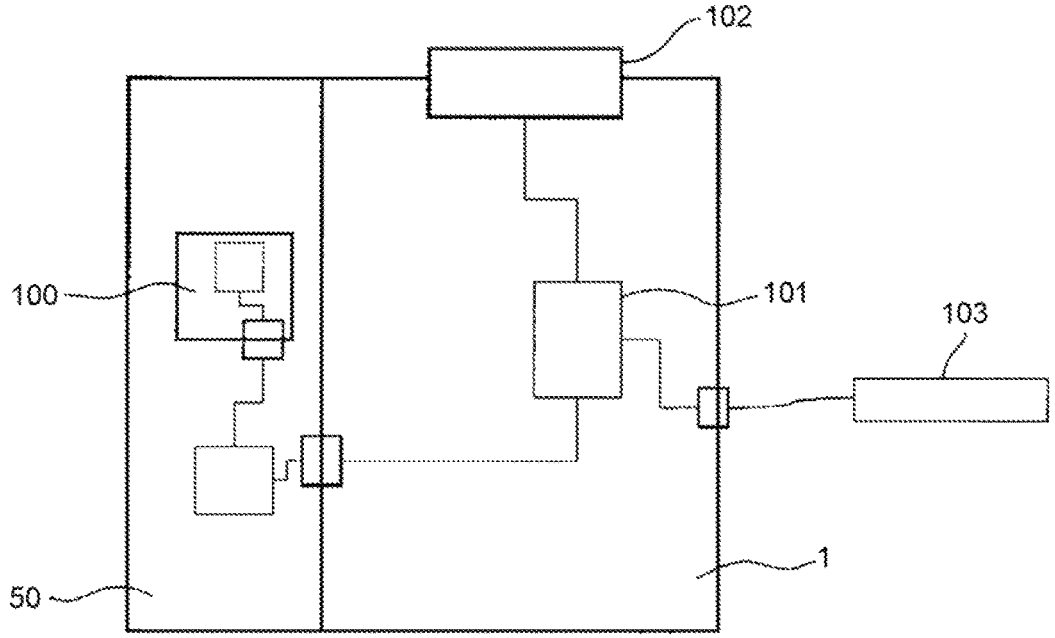

FIGS. 15A and 15B are schematic configuration diagrams of determining unit according to Example 1. The configuration illustrated in FIG. 15A includes a determining unit 101 in the copier 1. The identification information related to the machine type of the post-processing device 50 and the model of the optional part 100 is input from an operation unit 102 by a provider such as a service person, when the image forming system is installed, when the post-processing device 50 and the optional part 100 of the post-processing device 50 are added, or the like. The determining unit 101 calculates the inter-sheet time corresponding to each post-processing that can be selected in the image forming system, based on the identification information related to the machine type of the post-processing device 50 and the model of the optional part 100 being input. The corresponding inter-sheet operation is determined, from the inter-sheet time of each post-processing that can be selected in the image forming system.

If the post-processing device 50 is a type of machine that does not include an optional part (for example, members for stapling processing and punching processing are mounted as standard parts and are not detachable), information only related to the machine type of the post-processing device 50 is input from the operation unit 102. Consequently, the inter-sheet time corresponding to each post-processing that can be selected in the image forming system is calculated, based on the information related to the machine type of the post-processing device 50.

In recent years, copiers and printers are connected to LAN and are commonly used by a plurality of users. There are also times when the copiers and printers are connected to an Internet line, and a maintenance company, with which the maintenance agreement is made, can browse the maintenance information of the image forming system. As illustrated in FIG. 15B, the image forming system having the configuration illustrated in FIG. 15A may be connected to an external network 103 such as a LAN or an Internet line. By doing so, an administrator or the like of the image forming system can browse and alter the identification information related to the machine type of the post-processing device 50 and the model of the optional part 100 input, from the operation unit 102 via the external network 103.

Thus, even if there is omission or mistake in the identification information input from the operation unit 102, the identification information can be easily corrected. Also, the maintenance company, with which the maintenance agreement of the image forming system is made, can browse the identification information via the external network 103. Hence, the maintenance company can speedily recognize the status of addition or the status of change of the post-processing device 50 and the optional part 100, and any trouble that may occur on the post-processing device 50 and the optional part 100, in the image forming system. As a result, the user can receive appropriate support in a timely manner.

Figure 16A:
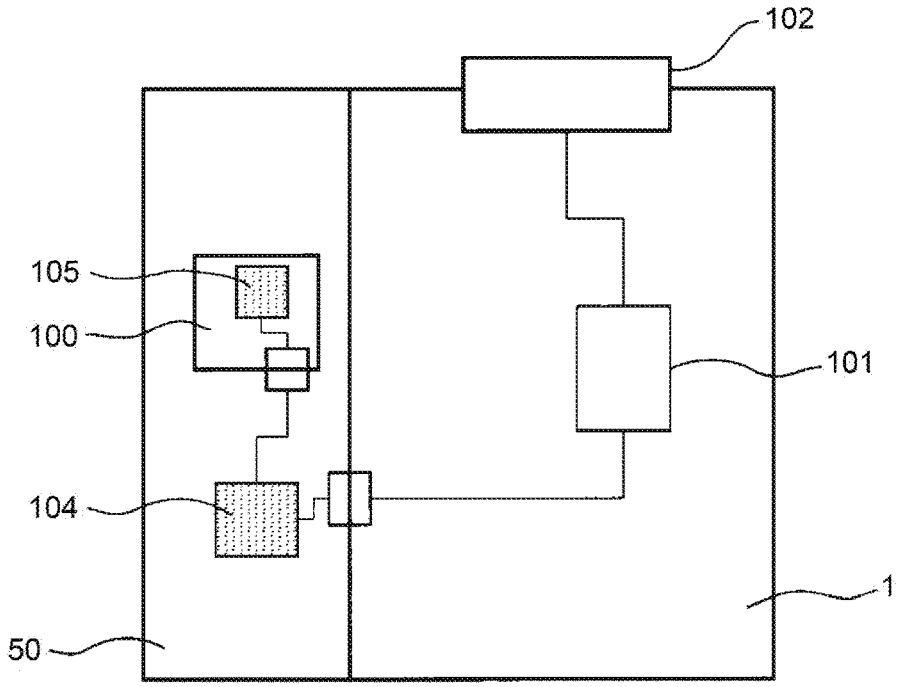
FIGS. 16A and 16B are schematic configuration diagrams of another examples of a determining unit that determines an inter-sheet operation corresponding to each post-processing that can be selected in the image forming system according to the second embodiment.
Figure 16B:
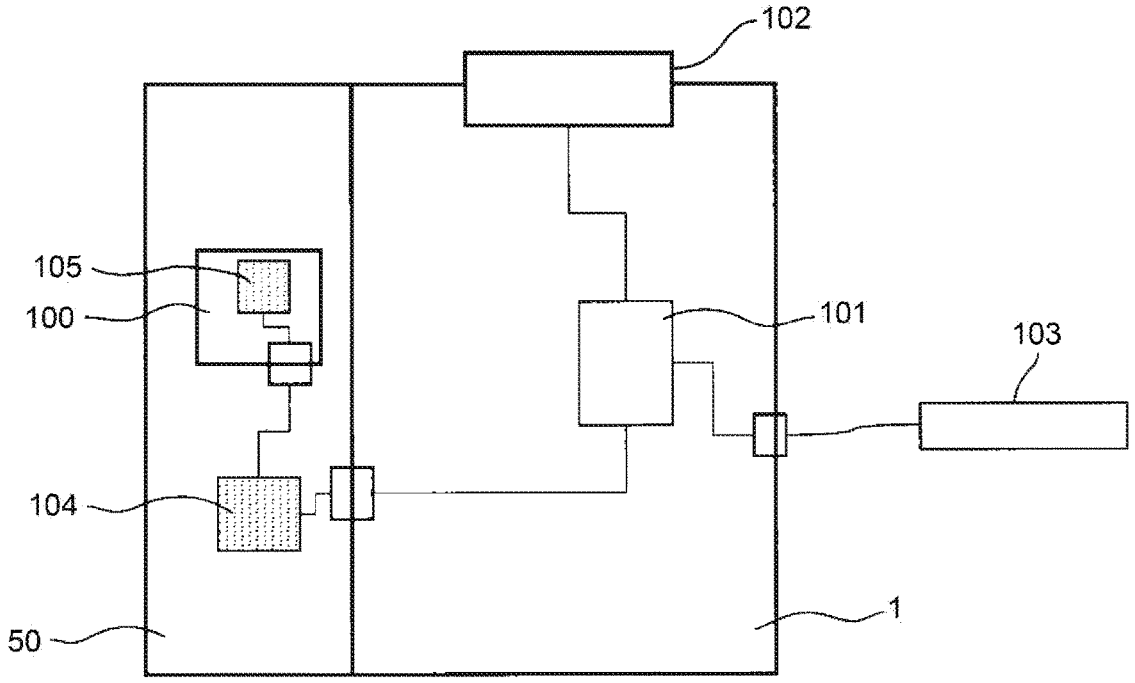

FIGS. 16A and 16B are schematic configuration diagrams of the determining unit according to Example 2. The configuration illustrated in FIG. 16A includes the determining unit 101 in the copier 1, and also includes a post-processing device storage unit 104 in the post-processing device 50, and an optional part storage unit 105 in the optional part 100. The machine type information of the post-processing device 50 is stored in the post-processing device storage unit 104, and the model information of the optional part is stored in the optional part storage unit 105.

With the communication and connection among the copier 1, the post-processing device 50, and the optional part 100, the determining unit 101 can identify the machine type information of the post-processing device 50 and the model information of the optional part 100. The determining unit 101 calculates the inter-sheet time corresponding to each post-processing that can be selected in the image forming system, based on the identification information related to the machine type of the post-processing device 50 and the model of the optional part 100 being identified. Then, from the inter-sheet time of each post-processing that can be selected in the image forming system, corresponding inter-sheet operation is determined. By doing so, it is possible to prevent human errors such as input omission and input mistakes, because a provider does not need to input the pieces of information from the operation unit 102 and the like.

If the post-processing device 50 is a type of machine that does not include an optional part (for example, members for stapling processing and punching processing are mounted as standard parts and are not detachable), the inter-sheet time corresponding to each post-processing that can be selected in the image forming system is calculated, based on the information related to the machine type of the post-processing device 50 stored in the post-processing device storage unit 104.

In FIG. 16B, the image forming system having the configuration as illustrated in FIG. 16A is connected to the external network 103. Similarly to Example 1 described with reference to FIG. 15B, by appropriately providing the maintenance company with information related to addition or change of the post-processing device 50 and the optional part 100, and information on a trouble in the image forming system, it is possible to receive an appropriate support in a timely manner. For example, the post-processing device 50 connected to the copier 1 and the optional part 100 thereof, are confirmed via the operation unit 102 and the network environment. Then, in the image forming system, if obvious trouble is detected in the post-processing device 50 and the optional part 100 of the image forming system, the connection is released to stop the usage of the function. Hence, a service person can provide speedy support.

The determining unit of Example 1 and the determining unit of Example 2 do not exclude each another. In other words, the determining unit described above may be configured so that it can obtain identification information by using either of a method of inputting from the operation unit 102, or a method in which the determining unit 101 accesses the post-processing device storage unit 104 and the optional part storage unit 105 included in the post-processing device 50 and the optional part 100, respectively.

The image forming system according to the present embodiment is not limited to the image forming system in which the copier 1 and the post-processing device 50 are separately provided and arranged side by side. The image forming system may also be the copier 1 integrally provided with the post-processing device 50.

Third Embodiment

A third embodiment according to the present invention will now be described with reference to the accompanying drawings. The schematic configuration of the image forming system according to the present embodiment is the same as the schematic configuration of the image forming system according to the first embodiment illustrated in FIG. 2. The schematic configuration of the post-processing device included in the image forming system according to the present embodiment is the same as the schematic configuration of the post-processing device illustrated in FIG. 3. An example of the schematic configuration of the fixing device installed in the copier included in the image forming system according to the present embodiment is the same as the example of the schematic configuration of the fixing device illustrated in FIG. 4.

In the image forming system according to the present embodiment, there is no need to output the charging bias and the developing bias, which are output during normal image formation, when the interval between the sheets is considerably extended. There is also no need to operate the photoconductor drum 5 and a developing motor, to obtain the linear velocity of the normal image formation, when the interval between the sheets is considerably extended. Because there is no need to operate each member in the image formation unit such as the photoconductor drum 5, it is a useless operation. As a result, in the image forming system according to the present embodiment, it is possible to prevent the lives of the units, the supplies, and the parts from being shortened, and to reduce the power consumption.

In the present embodiment, when a post-processing operation that significantly extends the inter-sheet time is included, the linear velocity of the photoconductor drum 5 and the developing motor is switched without stopping the image formation operation itself. As in the timing chart illustrated in FIG. 17, the switching is performed from the standard speed at the normal image formation to the low speed. As a result, it is possible to reduce the stress on a developer per time period, prevent the deterioration of the developer, and prevent the life of the developer from lowering.

Figure 17:
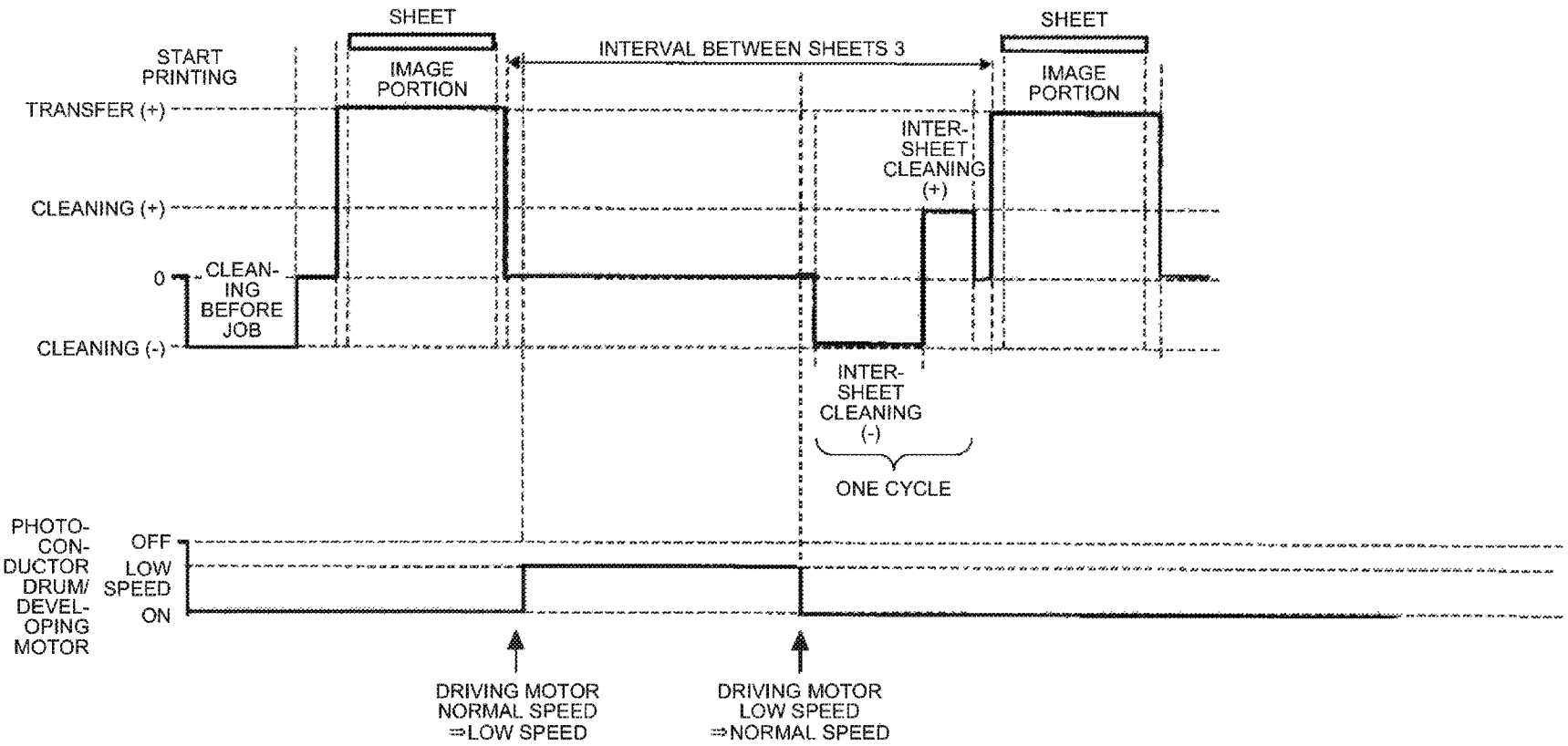
FIG. 17 is a timing chart when the linear velocity of a photoconductor drum and a developing motor is switched, as an inter-sheet operation.
Figure 18:
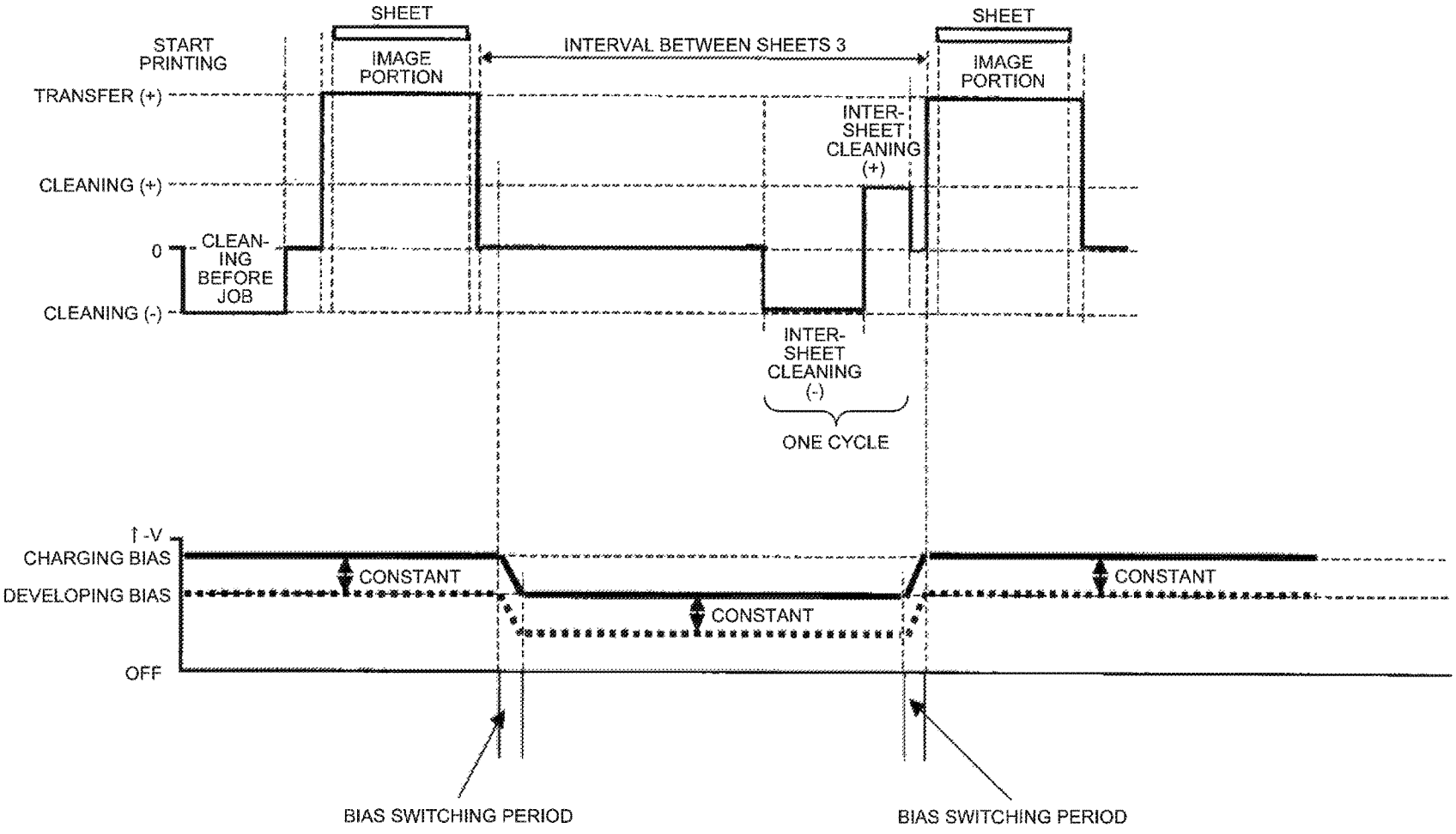
FIG. 18 is a timing chart when the charging bias and the developing bias are switched, as an inter-sheet operation.
Figure 19:
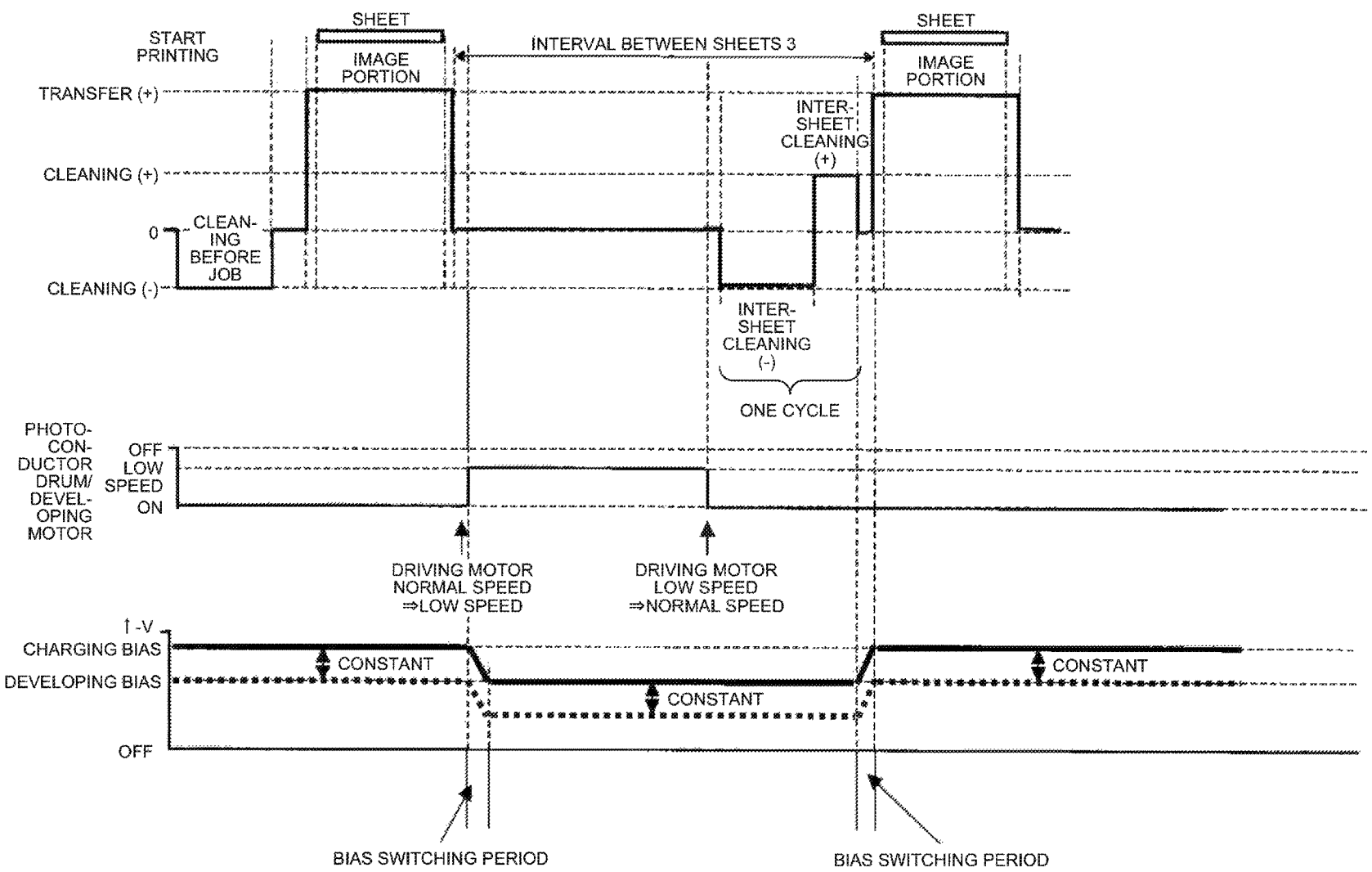
FIG. 19 is a timing chart when the linear velocity of the photoconductor drum and the developing motor are switched, as well as when the charging bias and the developing bias are switched, as an inter-sheet operation.

FIG. 18 is a timing chart when the charging bias and the developing bias are switched as an inter-sheet operation, when the post-processing operation that significantly extends the inter-sheet time is included. FIG. 19 is a timing chart when the linear velocity of the photoconductor drum 5 and the developing motor is switched as illustrated in FIG. 17, as well as when the charging bias and the developing bias are switched, as an inter-sheet operation, when the post-processing operation that significantly extends the inter-sheet time is included.

In general, when high charging bias is applied, a hazard to the photoconductor drum 5 is increased, and there is a possibility of affecting the image quality over time. As a result, the hazard to the photoconductor drum 5 can be reduced, by lowering the charging bias as much as possible. Because there is no need to set the charging bias to high at the interval between the sheets, it is possible to lower the charging bias than that during the image formation. However, if only the charging bias is lowered, background fog and carrier adhesion may occur. Therefore, to maintain the background potential constant, the developing bias needs to be adjusted at the same time. Consequently, as illustrated in FIG. 18 and FIG. 19, the charging bias and the developing bias are switched during the image formation and during the inter-sheet time, so that the absolute values of the charging bias and the developing bias after the change, become smaller than those of the charging bias and the developing bias before the change. The charging bias after the change is preferably a charging start voltage. However, if the charging bias is too small, the potential on the surface of the photoconductor drum becomes zero, and cannot maintain the background potential. Therefore, by setting the charging bias after the change to a charging start voltage by which the charging potential starts accumulating on the surface of the photoconductor drum, in addition to the background potential, the hazard can be minimized. It is also possible to maintain the background potential. When the charging bias and the developing bias are to be changed, the difference between the charging bias and the developing bias after the change is made same as the difference between the charging bias and the developing bias before the change.

Figure 20:
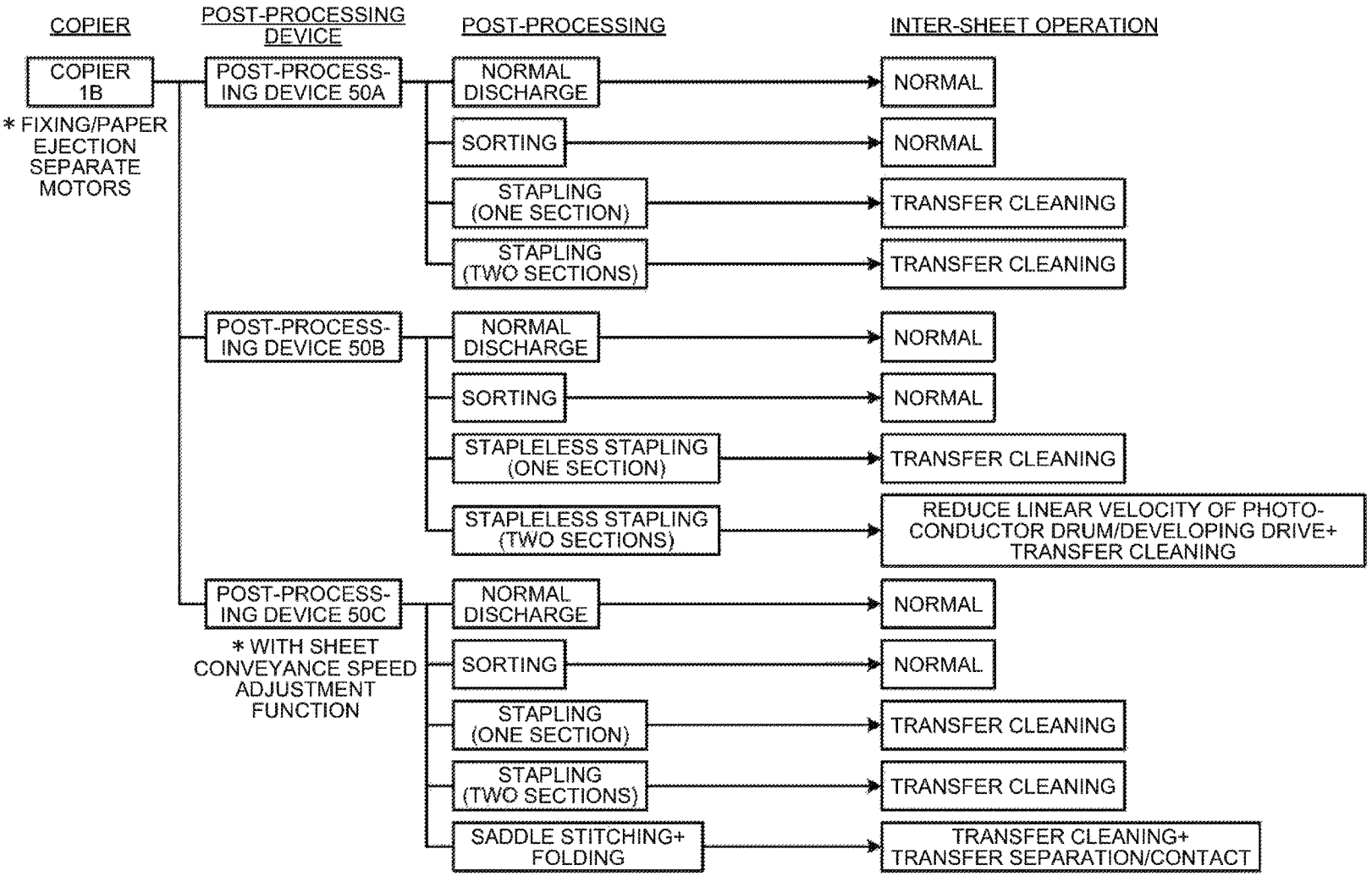
FIG. 20 is a diagram illustrating an example of a matrix of combinations of a copier and a post-processing device, and inter-sheet operations in post-processings performed by the post-processing device, in the image forming system according to a third embodiment.
Figure 21:
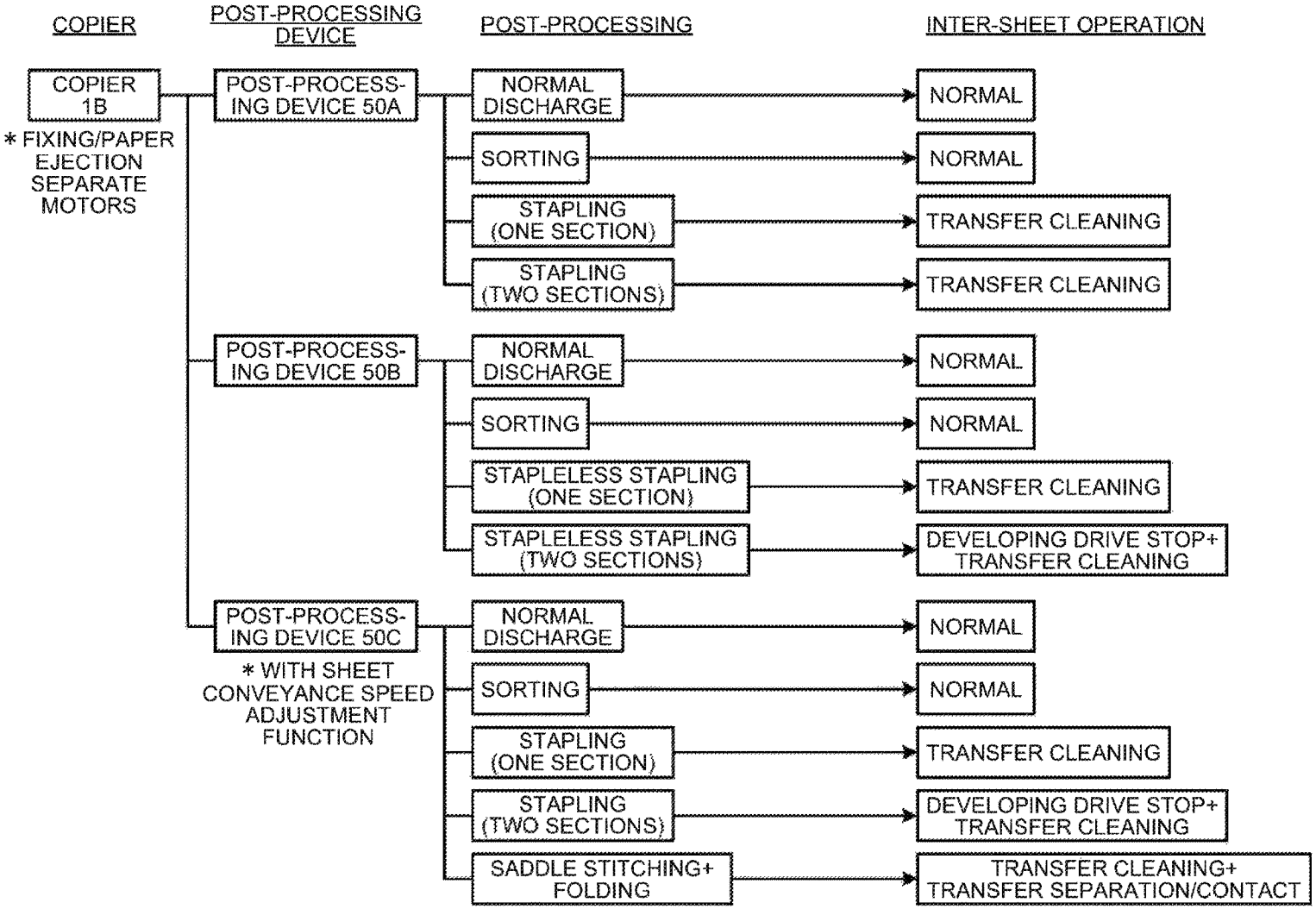
FIG. 21 is a diagram illustrating another example of a matrix of combinations of a copier and a post-processing device, and inter-sheet operations in post-processings performed by the post-processing device, in the image forming system according to the third embodiment.

FIG. 20 and FIG. 21 illustrate a matrix of combinations of the Copier 1 and the post-processing device 50 according to the present embodiment, and specific inter-sheet operations in post-processings performed by the post-processing device 50. In the copier 1B, which is a type of machine that uses separate motors to drive the fixing device and the paper ejection unit, as illustrated in FIG. 20 and FIG. 21, the conveyance speed of the sheet P can be increased, while the sheet is delivered to the post-processing devices 50A, 50B, and 50C, which are different types of machines, from the copier 1B.

In FIG. 20, in the copier 1B connected to the post-processing device 50B, when a stapling processing in which two sections of the sheets P are bound that significantly extends the inter-sheet time is performed in a post-processing, an operation to reduce the linear velocity of the photoconductor drum and the developing motor in addition to transfer cleaning is performed as the inter-sheet operation. When the post-processing that significantly extends the inter-sheet time is performed, deterioration of the developer is prevented, by reducing the driving speed (linear velocity) of the photoconductor drum 5 and the developing motor. Because the travel distance of the transfer roller per unit time is shortened, it is also possible to reduce the stain on the transfer roller 7. The inter-sheet operations excluding when the copier 1B and the post-processing device 50B are connected and stapleless stapling operation is performed on two sections of the sheet, as illustrated in FIG. 8-3, are the same as those described with reference to FIG. 14.

In FIG. 21, in the copier 1B connected to the post-processing device 50B, when the stapleless stapling operation to bind two sections of the sheet P is performed in a post-processing, an operation to stop the drive of the developing motor in addition to transfer cleaning is performed, as the inter-sheet operation. In a copier 1C connected to the post-processing device 50C, when a stapling operation with staples to bind two sections of the sheet P is performed in a post-processing, an operation to stop the drive of the developing motor in addition to transfer cleaning is performed, as the inter-sheet operation. In this manner, by only stopping the developing motor in the image formation unit, various types of bias and operations to startup and shutdown each drive can be omitted. Therefore, it is possible to deal with the shorter interval between the sheets. The inter-sheet operations excluding when the copier 1B and the post-processing device 50B are connected and a stapleless stapling operation is performed on two sections of the sheet, and when the copier 1B and the post-processing device 50C are connected and a stapling operation with staples is performed on two sections of the sheet, are the same as the example described with reference to FIG. 14. Various types of configurations and various types of controls in the image forming system described in the first embodiment and the second embodiment may also be applicable to the image forming system according to the present embodiment.

As described above, the inter-sheet operation can be made into an understandable matrix, with the combinations of the main body and the peripheral device, and the post-processing operation thereof. By allowing the device to have control based on the table of the combinations, an optimum inter-sheet operation can be performed. As a result, it is possible to prevent the staining of the back surface and the edge surface due to the staining of the transfer roller 7. It is also possible to prevent the lives of the units, the supplies, and the parts from being shortened, and to reduce the power consumption.

It is also possible to prevent accumulation of stain on the transfer roller 7, by reducing the amount of background fog toner. When the drive of the photoconductor drum 5 and the drive of developing are separated, or when only developing can be stopped by clutching, the amount of background fog can be reduced by stopping the developing drive. When the developing drive is stopped, it is possible to prevent needless idling of the developing device. Consequently, it is possible to prevent the stress applied to the developer, thereby extending the life of the developer. Because startup processing and shutdown processing of various types of bias such as charging bias and drive of various members such as the photoconductor drum 5 are not required, it is possible to perform in the shorter interval between the sheets.

The descriptions above are examples, and the present invention has specific effects for each of the following aspects.

(Aspect A)

An image forming system includes an image bearer such as the photoconductor drum 5 that bears a toner image and is rotatably provided, a transfer member such as the transfer roller 7 that comes into contact with the image bearer, forms a transfer nip to transfer the toner image on the image bearer to a sheet, and is rotatably provided, a bias applying unit such as the power supply unit 35 that applies bias to the transfer member, and a post-processing unit such as the post-processing device 50 that can perform a post-processing on the sheet on which the toner image is formed. The image forming system can execute a transfer cleaning operation to move toner from the transfer member to the image bearer by electrostatic force caused by cleaning bias applied by the bias applying unit in a state where the image bearer and the transfer member are rotated, to clean the transfer member, as an inter-sheet operation performed when at least one of inter-sheet, areas that exist on the image bearer passes through the transfer nip during a successive image forming period during which a plurality of sheets are successively fed to form images. The image forming system can execute a rotation stop operation to stop rotation of the image bearer and the transfer member, as the inter-sheet operation, in addition to the transfer cleaning operation, before or after the transfer cleaning operation is executed.

In Aspect A, when the inter-sheet time is longer than the time required to sufficiently clean the transfer member by the transfer cleaning operation, to secure post-processing time, the rotation stop operation can be executed as an inter-sheet operation, before or after the transfer cleaning operation is executed. As a result, there is no need to rotate the image bearer and the transfer member needlessly, exceeding the time required to sufficiently clean the transfer member by the transfer cleaning operation. Consequently, it is possible to prevent the lives of the image bearer and the transfer member from shortening by that amount. Therefore, it is possible to extend the lives of the image bearer and the transfer member, while preventing the toner stain on the transfer member.

(Aspect B)

In the image forming system according to Aspect A, the post-processing unit can selectively perform a plurality of different post-processings, and depending on a post-processing selected from the post-processings, executes the rotation stop operation as the inter-sheet operation, in addition to the transfer cleaning operation, before or after the transfer cleaning operation is executed. Thus, as explained in the embodiments described above, when the post-processing, which is estimated in advance that the inter-sheet time will be significantly long, is selected from the post-processings, it is possible to prevent the image bearer and the transfer member from rotating needlessly in the inter-sheet operation.

(Aspect C)

In the image forming system according to Aspect B, execution time of the transfer cleaning operation is constant regardless of a post-processing selected from the post-processings. Thus, even if the length of the inter-sheet time is changed by various controls, as explained in the embodiments described above, it is possible to reduce electrical hazard to the image bearer.

(Aspect D)

In the image forming system according to any one of Aspect A to Aspect C, application time of the cleaning bias by the bias applying unit in the transfer cleaning operation is set to a time during which the transfer member is rotated equal to or more than once. Thus, as explained in the embodiments described above, it is possible to clean the toner stain on the whole circumference of the transfer member.

(Aspect E)

In the image forming system according to any one of Aspect A to Aspect D, the cleaning bias includes a first cleaning bias having the same polarity as a regular charge polarity of toner, and a second cleaning bias having a polarity reverse to the regular charge polarity of toner and applied after the first cleaning bias is applied. Thus, as explained in the embodiments described above, the toner having both positive polarity and negative polarity exists on the surface of the transfer member. By applying both of the bias having positive polarity and the bias having negative polarity, it is possible to further effectively prevent the toner stain on the transfer member.

(Aspect F)

In the image forming system according to any one of Aspect A to Aspect E, current that flows through the transfer nip is controlled to be 0 [μA] in the inter-sheet area, excluding when the transfer cleaning operation is being executed. Thus, as explained in the embodiments described above, it is possible to prevent the toner from accumulating on the surface of the transfer member in the inter-sheet area.

(Aspect G)

The image forming system according to any one of Aspect A to Aspect F further includes a charging unit such as the charging roller 41 that charges a surface of the image bearer, and developing unit such as the developing device 42 that develops a latent image formed by exposing the charged surface of the image bearer by using toner. The image forming system can selectively execute a drive speed changing operation of the image bearer and the developing unit and a drive stop operation of at least one of the image bearer and the developing unit, as the inter-sheet operation, in addition to the transfer cleaning operation. Thus, as explained in the embodiments described above, it is possible to prevent the lives of the units, the supplies, and the parts from shortening.

(Aspect H)

In the image forming system according to Aspect G, the image forming system switches charging bias of the charging unit and developing bias of the developing unit, between during image formation and during interval between sheets. Thus, as explained in the embodiments described above, it is possible to reduce the power consumption.

(Aspect I)

In the image forming system according to Aspect H, a difference between the charging bias and the developing bias after being switched is preferably the same as a difference between the charging bias and the developing bias before being switched.

(Aspect J)

In the image forming system according to any one of Aspect G to Aspect I, the image forming system adjusts a drive speed of the image bearer and the developing unit, according to at least one of the post-processing unit connected to a main body of an image forming device and a post processing selected from the post-processings, as the inter-sheet operation. Thus, as explained in the embodiments described above, it is possible to prevent the deterioration of a developer. Because the travel distance of the transfer member per unit time is also shortened, it is possible to reduce the staining of the transfer member.

(Aspect K)

In the image forming system according to any one of Aspect G to Aspect I, the image forming system stops a drive of the developing unit according to at least one of the post-processing unit connected to a main body of an image forming device and a post processing selected from the post-processings, as the inter-sheet operation. Thus, as explained in the embodiments described above, it is possible to reduce the stress on a developer, and extend the life of the developer. Because startup processing and shutdown processing of various types of bias such as the charging bias and drive of various members such as the image bearer are not required, it is possible to perform the inter-sheet operation even in a shorter interval between the sheets.

(Aspect L)

The image forming system according to any one of Aspect A to Aspect K further includes a contact/separation unit to cause the image bearer and the transfer member contact and separate from each other. The image forming system can execute a contact/separation operation of the image bearer and the transfer member by the contact/separation unit, depending on a post-processing selected from the post-processings, as the inter-sheet operation, in addition to the transfer cleaning, before or after the transfer cleaning operation is executed. Thus, as explained in the embodiments described above, by separating the image bearer and the transfer member in the inter-sheet area, it is possible to prevent toner from adhering on the surface of the transfer member from the image bearer.

(Aspect M)

In the image forming system according to any one of Aspect A to Aspect L, the image forming system can execute a predetermined adjustment operation depending on a post-processing selected from the post-processings, as the inter-sheet operation, in addition to the transfer cleaning operation, before or after the transfer cleaning operation is executed. Thus, as explained in the embodiments described above, it is possible to execute the adjustment operation, which is conventionally carried out by lowering the productivity of printed matter, without lowering the productivity of printed matter.

(Aspect N)

The image forming system according to Aspect M further includes an image formation unit that includes the image bearer, a charging unit to charge a surface of the image bearer, a latent image writing unit to write a latent image on the charged surface of the image bearer, and a developing unit to obtain a toner image by developing the latent image, and a toner adhesion amount detecting unit that detects a toner adhesion amount of the toner image formed by the image formation unit. The adjustment operation includes control to adjust an image formation condition of the image formation unit, based on a result obtained by causing the toner adhesion amount detecting unit to detect the toner adhesion amount of a toner image for detecting the toner adhesion amount formed by the image formation unit under a predetermined image formation condition. Thus, as explained in the embodiments described above, it is possible to adjust the image formation condition to enable an appropriate image density to be obtained, without lowering the productivity of printed matter.

(Aspect O)

The image forming system according to Aspect M further includes an image formation unit that includes the image bearer, a charging unit to charge a surface of the image bearer, a latent image writing unit to write a latent image on the charged surface of the image bearer, and a developing unit to obtain a toner image by developing the latent image, and a toner image position detecting unit that detects a position of the toner image formed on the image bearer. The adjustment operation includes control to adjust an image formation condition of the image formation unit so as to reduce positional misalignment of the toner image, based on a result obtained by causing the toner image position detecting unit to detect a position of a toner image for detecting a toner image position formed by the image formation unit under a predetermined image formation condition. Thus, as explained in the embodiments described above, it is possible to adjust the positional misalignment of the toner image, without lowering the productivity of printed matter.

(Aspect P)

The image forming system according to Aspect M further includes an image formation unit that includes the image bearer, a charging unit to charge a surface of the image bearer, a latent image writing unit to write a latent image on the charged surface of the image bearer, and a developing unit to obtain a toner image by developing the latent image, and a toner supplying unit to supply toner to the developing unit. The adjustment operation includes control to forcibly consume toner accommodated in the developing unit by forming a toner image for consumption on the image bearer, and supply toner to the developing unit by the toner supplying unit. Thus, as explained in the embodiments described above, it is possible to appropriately adjust the charging performance of the toner accommodated in the developing unit, without lowering the productivity of printed manner.

(Aspect Q)

In the image forming system according to any one of Aspect A to Aspect P, a rotation distance of the image bearer in the inter-sheet area changes, depending on a post-processing performed by the post-processing unit. Thus, as explained in the embodiments described above, it is possible to execute an appropriate inter-sheet operation corresponding to the length of the inter-sheet area.

(Aspect R)

In the image forming system according to Aspect Q, the post-processing unit includes a binding unit to bind a sheet without using a staple. Thus, as explained in the embodiments describe above, it is possible to prevent toner stain from occurring on a transfer member, even if stapleless binding processing that significantly extends a post-processing time is performed.

(Aspect S)

In the image forming system according to any one of Aspect A to Aspect R, the image bearer is a photoconductor and directly transfers a toner image from the photoconductor to a sheet. Thus, as explained in the embodiments described above, it is possible to prevent toner from accumulating on a surface of a transfer member, in a direct transfer system in which the toner is easily accumulated on the transfer member.

(Aspect T)

In the image forming system according to any one of Aspect A to Aspect S, the transfer member is a transfer roller. Thus, as explained in the embodiments described above, it is possible to prevent, toner from accumulating on the surface of the transfer roller.

(Aspect U)

The image forming system according to any one of Aspect A to Aspect U further includes a determining unit such as the determining unit 101 that determines the inter-sheet operation, and an operation unit such as the operation unit 102 for an operation. The post-processing unit is detachably attached to a main body, and configured such that an optional member such as the optional part 100, which is replaced according to a type of post-processing, is mountable. The determining unit determines the inter-sheet operation corresponding to the post-processing, based on identification information of the post-processing unit installed in the main body and the optional member mounted on the post-processing unit, input from the operation unit.

The inter-sheet operation to be performed needs to be changed based on the length of the inter-sheet time. Consequently, to determine the inter-sheet operation, the inter-sheet time needs to be calculated. The inter-sheet time changes according to the post-processing to be performed. The inter-sheet time also changes, even if the post-processing performed in the image forming system is the same, if the processing ability of the post-processing unit installed in the main body or the optional member mounted on the post-processing unit is different. To calculate the inter-sheet time of each post-processing that can be selected in the image forming system, the identification information related to the post-processing unit installed in the main body of the image forming system needs to be obtained. The inter-sheet time and the inter-sheet operation corresponding to each post-processing that can be executed in the image forming system can be calculated and determined based on the identification information related to a machine type of the post-processing unit installed in the main body and a model of the optional member installed in the post-processing unit, input from the operation unit.

(Aspect V)

The image forming system according to any one of Aspect A to Aspect T further includes a determining unit to determine the inter-sheet operation, and an operation unit for an operation. The post-processing unit is detachably attached to a main body and configured such that an optional member, which is replaced according to a type of post-processing, is mountable. The determining unit determines the inter-sheet operation corresponding to the post-processing, based on identification information of the post-processing unit installed in the main body and the optional member mounted on the post-processing unit, input from the operation unit.

(Aspect W)

In the image forming system according to Aspect U or Aspect V, the image forming system is connected to an external network such as the external network 103, and a user or the like can browse and alter the identification information input from the operation unit via the external network.

When the image forming system is connected to an external network such as a LAN or an Internet line, an administrator or the like can browse and alter the identification information related to a machine type of the post-processing unit and a model of the optional member input from an operation unit via the external network. Consequently, it is possible to easily correct the identification information, even if there is omission or mistake in the identification information input from the operation unit. If the external network is an Internet line, a maintenance company, with which the maintenance agreement of the image forming system is made, can browse the identification information. Hence, the maintenance company can speedily recognize the status of addition or the status of change of the post-processing unit and the optional part, and any trouble that may occur on the post-processing unit and the optional part, in the image forming system. As a result, the user can receive appropriate support in a timely manner.

(Aspect X)

The image forming system according to any one of Aspect A to Aspect T further includes a determining unit such as the determining unit 101 to determine the inter-sheet operation. The post-processing unit is detachably attached to a main body and configured so that an optional member, which is replaced according to a type of post-processing, is mountable. The post-processing device and the optional member include storage units such as the post-processing device storage unit 104 and the optional part storage unit 105 to store respective identification information. The determining unit determines the inter-sheet operation corresponding to the post-processing, based on the identification information stored in the storage units.

The machine type information of the post-processing unit is stored in the storage unit of the post-processing unit, and the model information of the optional member is stored in the storage unit of the optional member. The inter-sheet time and the inter-sheet operation corresponding to each post-processing that can be executed in the image forming system can be calculated and determined based on the identification information related to a machine type of the post-processing unit and a model of the optional member installed in the post-processing unit being stored. By doing so, it is possible to prevent human errors such as input, omission and input mistakes, because a user or the like does not need to input the identification information from an operation unit.

(Aspect Y)

The image forming system according to any one of Aspect A to Aspect T further includes a determining unit to determine the inter-sheet operation. The post-processing unit is detachably attached to a main body. The post-processing device includes a storage unit to store identification information of the post-processing device. The determining unit determines the inter-sheet operation corresponding to the post-processing, based on the identification information stored in the storage unit.

(Aspect Z)

In the image forming system according to Aspect X or Aspect Y, the image forming system is connected to an external network, and a user or the like can browse and alter the identification information stored in the storage unit via the external network.

When the image forming system is connected to the external network such as an Internet line, a maintenance company, with which the maintenance agreement of the image forming system is made, can browse the identification information. Hence, the maintenance company can speedily recognize the status of addition or the status of change of the post-processing unit and the optional member, and any trouble that may occur on the post-processing unit and the optional member, in the image forming system. As a result, the user can receive appropriate support in a timely manner.

An embodiment has an excellent effect that the lives of the image bearer and the transfer member can be extended while preventing toner stain on the transfer member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming system comprising:

a rotatable image bearing drum to bear a toner image;

a transfer roller or belt to form a transfer nip between the image bearing drum and the transfer roller or belt;

a power supply to output a bias to transfer the toner image from the image bearing drum to a sheet in the transfer nip; and a sheet processor to perform a post-processing on the sheet on which the toner image is formed, wherein when the post-processing is performed and an inter-sheet area between a plurality of sheets is in the transfer nip, the image forming system stops rotation of the image bearing drum.

2. The image forming system according to claim 1, wherein the sheet processor includes a binding device to bind a bundle of sheets, and the post-processing includes a binding processing on the bundle of sheets.

3. The image forming system according to claim 1, wherein the sheet processor includes a folding device to fold the sheet, and the post-processing includes a folding processing on the sheet.

4. The image forming system according to claim 1, wherein the power supply outputs a cleaning bias to move toner from the transfer roller or belt to the image bearing drum when the inter-sheet area is in the transfer nip, and wherein the image forming system stops rotation of the image bearing drum before or after the power supply outputs the cleaning bias.

5. The image forming system according to claim 4, wherein the power supply outputs the cleaning bias for a time period during which the transfer roller or belt rotates equal to or more than once.

6. The image forming system according to claim 4, wherein the cleaning bias includes a first cleaning bias including a first polarity and a second cleaning bias including a second polarity opposite to the first polarity.

7. The image forming system according to claim 1, wherein the transfer roller forms the transfer nip between the image bearing drum and the transfer roller.

8. The image forming system according to claim 1, wherein the image bearing drum is a photoconductor drum.

9. The image forming system according to claim 1, wherein the power supply applies the bias to the transfer roller or belt.

10. An image forming system comprising:

a rotatable image bearing drum to bear a toner image;

a transfer roller or belt to form a transfer nip between the image bearing drum and the transfer roller or belt;

a power supply to output a bias to transfer the toner image from the image bearing drum to a sheet in the transfer nip; and a sheet processor to selectively perform a first post-processing on the sheet on which the toner image is formed and a second post-processing on the sheet on which the toner image is formed, wherein when the first post-processing is performed and an inter-sheet area between a plurality of sheets is in the transfer nip, the image forming system stops rotation of the image bearing drum, and wherein when the second post-processing is performed and the inter-sheet area is in the transfer nip, the image forming system maintains rotation of the image bearing drum.

11. The image forming system according to claim 10, wherein a length of the inter-sheet area when the first post-processing is performed is longer than the length of the inter-sheet area when the second post-processing is performed.

12. The image forming system according to claim 10, wherein the sheet processor includes a binding device to bind a bundle of sheets, and the first post-processing includes a binding processing on the bundle of sheets.

13. The image forming system according to claim 10, wherein the sheet processor includes a folding device to fold the sheet, and the first post-processing includes a folding processing on the sheet.

14. The image forming system according to claim 10, wherein the sheet processor includes a sorting device to sort the sheet, and the second post-processing includes a sorting processing of the sheet.

15. The image forming system according to claim 10, wherein the power supply outputs a cleaning bias to move toner from the transfer roller or belt to the image bearing drum when the inter-sheet area is in the transfer nip, and wherein when the first post-processing is performed and the inter-sheet area is in the transfer nip, the image forming system stops rotation of the image bearing drum before or after the power supply outputs the cleaning bias.

16. The image forming system according to claim 15, wherein the power supply outputs the cleaning bias for a time period during which the transfer roller or belt rotates equal to or more than once.

17. The image forming system according to claim 15, wherein the cleaning bias includes a first cleaning bias including a first polarity and a second cleaning bias including a second polarity opposite to the first polarity.

18. An image forming system comprising:

a rotatable image bearing drum to bear a toner image;

a transfer roller or belt to form a transfer nip between the image bearing drum and the transfer roller or belt;

a power supply to output a bias to transfer the toner image from the image bearing drum to a sheet in the transfer nip; and a sheet processor to perform a post-processing on the sheet on which the toner image is formed, wherein a linear velocity of the image bearing drum, when the post-processing is performed and an inter-sheet area between a plurality of sheets is in the transfer nip, is lower than the velocity of the image bearing drum during image formation.

19. The image forming system according to claim 18, further comprising a charging device that charges a surface of the image bearing drum, and a developing device that develops a latent image formed by exposing the charged surface of the image bearing drum by using toner, wherein the image forming system switches a charging bias of the charging device and a developing bias of the developing device between when image formation is performed and when the inter-sheet area is in the transfer nip.

20. An image forming method comprising:

transferring a toner image from a rotatable image bearing drum to a sheet at a transfer position;

post-processing on the sheet on which the toner image is formed; and stopping rotation of the image bearing drum, when an inter-sheet area between a plurality of sheets is at the transfer position and the post-processing is performed.

21. The image forming method according to claim 20, further comprising cleaning a transfer roller or belt disposed opposite to the image bearing drum at a transfer portion by applying a cleaning bias to move toner from the transfer roller or belt to the image bearing drum when the inter-sheet area is at the transfer portion.

* * * * *